US005684920A

United States Patent [19]

Iwakami et al.

[11] Patent Number: 5,684,920

[45] Date of Patent: Nov. 4, 1997

[54] ACOUSTIC SIGNAL TRANSFORM CODING METHOD AND DECODING METHOD HAVING A HIGH EFFICIENCY ENVELOPE FLATTENING METHOD THEREIN

[75] Inventors: Naoki Iwakami, Yokohama; Takehiro Moriya; Satoshi Miki, both of Tokorozawa, all of Japan

[73] Assignee: Nippon Telegraph and Telephone, Tokyo, Japan

[21] Appl. No.: 402,660

[22] Filed: Mar. 13, 1995

[30] Foreign Application Priority Data

| | | | |
|---|---|---|---|
| Mar. 17, 1994 | [JP] | Japan | 6-047235 |
| Mar. 18, 1994 | [JP] | Japan | 6-048443 |
| May 25, 1994 | [JP] | Japan | 6-111192 |

[51] Int. Cl.[6] ..... G10L 9/16

[52] U.S. Cl. ..... 395/2.12; 395/2.1; 395/2.13; 395/2.28; 395/2.29; 395/2.67; 395/2.71

[58] Field of Search ..... 395/2, 2.1, 2.12, 395/2.13, 2.25, 2.26, 2.28, 2.29, 2.33, 2.24, 2.39, 2.67, 2.71, 2.72, 2.78, 2.17

[56] References Cited

U.S. PATENT DOCUMENTS

| | | | |
|---|---|---|---|
| 4,301,329 | 11/1981 | Taguchi | 395/2.67 |
| 4,790,016 | 12/1988 | Mazor et al. | 395/2.12 |
| 4,811,398 | 3/1989 | Copperi | 395/2 |
| 5,206,884 | 4/1993 | Bhaskar . | |
| 5,293,448 | 3/1994 | Honda | 395/2.17 |
| 5,473,727 | 12/1995 | Nishiguchi et al. | 395/2.1 |
| 5,504,832 | 4/1996 | Taguchi | 395/2.1 |

FOREIGN PATENT DOCUMENTS

| | | |
|---|---|---|
| 0337 636A2 | 10/1989 | European Pat. Off. . |
| 0481374A2 | 4/1992 | European Pat. Off. . |
| WO 90/13111 | 11/1990 | WIPO . |
| WO 92/21101 | 11/1992 | WIPO . |

*Primary Examiner*—Allen R. MacDonald
*Assistant Examiner*—Alphonso A. Collins
*Attorney, Agent, or Firm*—Pollock, Vande Sande & Priddy

[57] ABSTRACT

An input acoustic signal is subjected to modified discrete cosine transform processing to obtain its spectrum characteristics. Linear prediction coefficients are derived from the input acoustic signal in a linear prediction coding analysis part, and the prediction coefficients are subjected to Fourier transform in a spectrum envelope calculation part to obtain the envelope of the spectrum characteristics of the input acoustic signal. In a normalization part the spectrum characteristics are normalized by the envelope thereof to obtain residual coefficients. Another normalization part normalizes the residual coefficients by a residual-coefficients envelope predicted in a residual-coefficients envelope calculation part, thereby obtaining fine structure coefficients, which are vector-quantized in a quantization part. A de-normalization part de-normalizes the quantized fine structure coefficients. The residual-coefficients envelope calculation part uses the reproduced residual coefficients to predict the envelope of residual coefficients of the subsequent frame.

45 Claims, 19 Drawing Sheets

FREQ

ACOUSTIC SIGNAL TRANSFORM CODING METHOD AND DECODING METHOD HAVING A HIGH EFFICIENCY ENVELOPE FLATTENING METHOD THEREIN

BACKGROUND OF THE INVENTION

The present invention relates to a method which transforms an acoustic signal, in particular, an audio signal such as a musical signal or speech signal, to coefficients in the frequency domain and encodes them with the minimum amount of information, and a method for decoding such a coded acoustic signal.

At present, there is proposed a high efficiency audio signal coding scheme according to which original audio signal is segmented into frames each of a fixed duration ranging from 5 to 50 ms, coefficients in the frequency domain (sample values at respective points on the frequency axis) (hereinafter referred to as frequency-domain coefficients) obtained by subjecting the signal of each frame to a time-to-frequency transformation (for example, a Fourier transform) are separated into two pieces of information such as the envelope (the spectrum envelope) of the frequency characteristics of the signal and residual coefficients obtained by flattening the frequency-domain coefficients with the spectrum envelope, and the two pieces of information are coded. The coding methods that utilize such a scheme are an ASPEC (Adaptive Spectral Perceptual Entropy Coding) method, a TCWVQ (Transform Coding with Weighted Vector Quantization) method and an MPEG-Audio Layer III method. These methods are described in K. Brandenburg, J. Herre, J. D. Johnston et al., "ASPEC: Adaptive spectral entropy coding of high quality music signals," Proc. AES '91, T. Moriya and H. Suda, "An 8 Kbit/s transform coder for noisy channels," Proc. ICASSP '89, pp. 196–199, and ISO/IEC Standard IS-11172-3, respectively.

With these coding methods, it is desirable, for high efficiency coding, that the residual coefficients have as flat an envelope as possible. To meet this requirement, the ASPEC and the MPEG-Audio Layer III method split the frequency-domain coefficients into a plurality of subbands and normalize the signal in each subband by dividing it with a value called a scaling factor representing the intensity of the band. As shown in FIG. 1, a digitized acoustic input signal from an input terminal 11 is transformed by a time-to-frequency transform part (Modified Discrete Cosine Transform: MDCT) 2 into frequency-domain coefficients, which are divided by a division part 3 into a plurality of subbands. The subband coefficients are each applied to one of scaling factor calculation/quantization parts $\mathbf{4}_1$–$\mathbf{4}_n$, wherein a scaling factor representing the intensity of the band, such as an average or maximum value of the signal, is calculated and then quantized; thus, the envelope of the frequency-domain coefficients is obtained as a whole. At the same time, the subband coefficients are each provided to one of normalization parts $\mathbf{5}_1$–$\mathbf{5}_n$, wherein it is normalized by the quantized scaling factor of the subband concerned to subband residual coefficients. These subband residual coefficients are provided to a residual quantization part 6, wherein they are combined, thereafter being quantized. That is, the frequency-domain coefficients obtained in the time-to-frequency transform part 2 become residual coefficients of a flattened envelope, which are quantized. An index $I_R$ indicating the quantization of the residual coefficients and indexes indicating the quantization of the scaling factors are both provided to a decoder.

A higher efficiency envelope flattening method is one that utilizes linear prediction analysis technology. As is well-known in the art, linear prediction coefficients represent the impulse response of a linear prediction filter (referred to as an inverse filter) which operates in such a manner as to flatten the frequency characteristics of the input signal thereto. With this method, as shown in FIG. 2, a digital acoustic signal provided at the input terminal 11 is linearly predicted in a linear prediction analysis/prediction coefficient quantization part 7, then the resulting linear prediction coefficients $\alpha_0, \ldots, \alpha_p$ are set as filter coefficients in a linear prediction analysis filter, i.e. what is called an inverse filter 8, which is driven by the input signal from the terminal 11 to obtain a residual signal of a flattened envelope. The residual signal is transformed by the time-to-frequency transform (e.g. discrete cosine transform: DCT) part 2 into frequency-domain coefficients, that is, residual coefficients, which are quantized in the residual quantization part 6. The index $I_R$ indicating this quantization and an index $I_p$ indicating the quantization of the linear prediction coefficients are both sent to the decoder. This scheme is used in the TCWVQ method.

Any of the above-mentioned methods do no more than normalize the general envelope of the frequency characteristics and do not permit efficient suppression of such microscopic roughness of the frequency characteristics as pitch components that are contained in audio signals. This constitutes an obstacle to the compression of the amount of information involved when coding musical or audio signals which contain high-intensity pitch components.

The linear prediction analysis is described in Rabiner, "Digital Processing of Speech Signals," Chap. 8 (Prentice-Hall), the DCT scheme is described in K. R. Rao and P. Yip, "Discrete Cosine Transform Algorithms, Advantages, Applications," Cha. 2 (Academic Press), and the MDCT scheme is described in ISO/IEC Standards IS-11172-3.

SUMMARY OF THE INVENTION

An object of the present invention is to provide an acoustic signal transform coding method which permits efficient coding of an input acoustic signal with a small amount of information even if pitch components are contained in residual coefficients which are obtained by normalizing the frequency characteristics of the input acoustic signal with the envelope thereof, and a method for decoding the coded acoustic signal.

The acoustic signal coding method according to the present invention, which transforms the input acoustic signal into frequency-domain coefficients and encodes them, comprises: a step (a) wherein residual coefficients having a flattened envelope of the frequency characteristics of the input acoustic signal are obtained on a frame-by-frame basis; a step (b) wherein the envelope of the residual coefficients of the current frame obtained in the step (a) is predicted on the basis of the residual coefficients of the current or past frame to generate a predicted residual coefficients envelope (hereinafter referred to as a predicted residual envelope); a step (c) wherein the residual coefficients of the current frame, obtained in the step (a), are normalized by the predicted residual envelope obtained in the step (b) to produce fine structure coefficients; and a step (d) wherein the fine structure coefficients are quantized and indexes representing the quantized fine structure coefficients are provided as part of the acoustic signal coded output.

The residual coefficients in the step (a) can be obtained by transforming the input acoustic signal to frequency-domain coefficients and then flattening the envelope of the frequency characteristics of the input acoustic signal, or by flattening the envelope of the frequency characteristics of the input acoustic signal in the time domain and then transforming the input signal to frequency-domain coefficients.

To produce the predicted residual envelope in the step (b), the quantized fine structure coefficients are inversely normalized to provide reproduced residual coefficients, then the spectrum envelope of the reproduced residual coefficients is derived therefrom and a predicted envelope for residual coefficients of the next frame is synthesized on the basis of the spectrum envelope mentioned above.

In the step (b), it is possible to employ a method in which the spectrum envelope of the residual coefficients in the current frame is quantized so that the predicted residual envelope is the closest to the above-said spectrum envelope, and an index indicating the quantization is output as part of the coded output. In this instance, the spectrum envelope of the residual coefficients in the current frame and the quantized spectrum envelope of at least one past frame are linearly combined using predetermined prediction coefficients, then the above-mentioned quantized spectrum envelope is determined so that the linearly combined value becomes the closest to the spectrum envelope of the residual coefficients of the current frame, and the linearly combined value at that time is used as the predicted residual-coefficients envelope. Alternatively, the quantized spectrum envelope of the current frame and the predicted residual-coefficients envelope of the past frame are linearly combined, then the above-said quantized spectrum envelope is determined so that the linearly combined value becomes the closest to the spectrum envelope of the residual coefficients in the current frame, and the resulting linearly combined value at that time is used as the predicted residual-coefficients envelope.

In the above-described coding method, a lapped orthogonal transform scheme may also be used to transform the input acoustic signal to the frequency-domain coefficients. In such an instance, it is preferable to obtain, as the envelope of the frequency-domain coefficients, the spectrum amplitude of linear prediction coefficients obtained by the linear prediction analysis of the input acoustic signal and use the envelope to normalize the frequency-domain coefficients.

The coded acoustic signal decoding method according to the present invention comprises: a step (a) wherein fine structure coefficients decoded from an input first quantization index are de-normalized using a residual-coefficients envelope synthesized on the basis of information about past frames to obtain regenerated residual coefficients of the current frame; and a step (b) wherein an acoustic signal with the envelope of the frequency characteristics of the original acoustic signal is reproduced on the basis of the residual coefficients obtained in the step (a).

The step (a) may include a step (c) of synthesizing the envelope of residual coefficients for the next frame on the basis of the above-mentioned reproduced residual coefficients. The step (c) may include: a step (d) of calculating the spectrum envelope of the reproduced residual coefficients; and a step (e) of multiplying the spectrum envelope of predetermined one or more contiguous past frames by prediction coefficients to obtain the envelope of the residual coefficients of the current frame.

In the step (b) of reproducing the acoustic signal with the envelope of the frequency characteristics of the original acoustic signal, the envelope is added to reproduced residual coefficients in the frequency domain or residual signals obtained by transforming the input acoustic signal into the time domain.

In the above decoding method, the residual-coefficients envelope may be produced by linearly combining the quantized spectrum envelopes of the current and past frames obtained by decoding indexes sent from the coding side. Alternatively, the above-said residual-coefficients envelope may also be produced by linearly combining the residual-coefficients envelope of the past frame and the quantized envelope obtained by decoding an index sent from the coding side.

In general, the residual coefficients which are provided by normalizing the frequency-domain coefficients with the spectrum envelope thereof contain pitch components and appear as high-energy spikes relative to the overall power. Since the pitch components last for a relatively a long time, the spikes remain at the same positions over a plurality of frames; hence, the power of the residual coefficients has high inter-frame correlation. According to the present invention, since the redundancy of the residual coefficients is removed through utilization of the correlation between the amplitude or envelope of the residual coefficients of the past frame and the current one, that is, since the spikes are removed to produce the fine structure coefficients of an envelope flattened more than that of the residual coefficients, high efficiency quantization can be achieved. Furthermore, even if the input acoustic signal contains a plurality of pitch components, no problem will occur because the pitch components are separated in the frequency domain.

DESCRIPTION OF THE PREFERRED EMBODIMENTS

Figure 3:
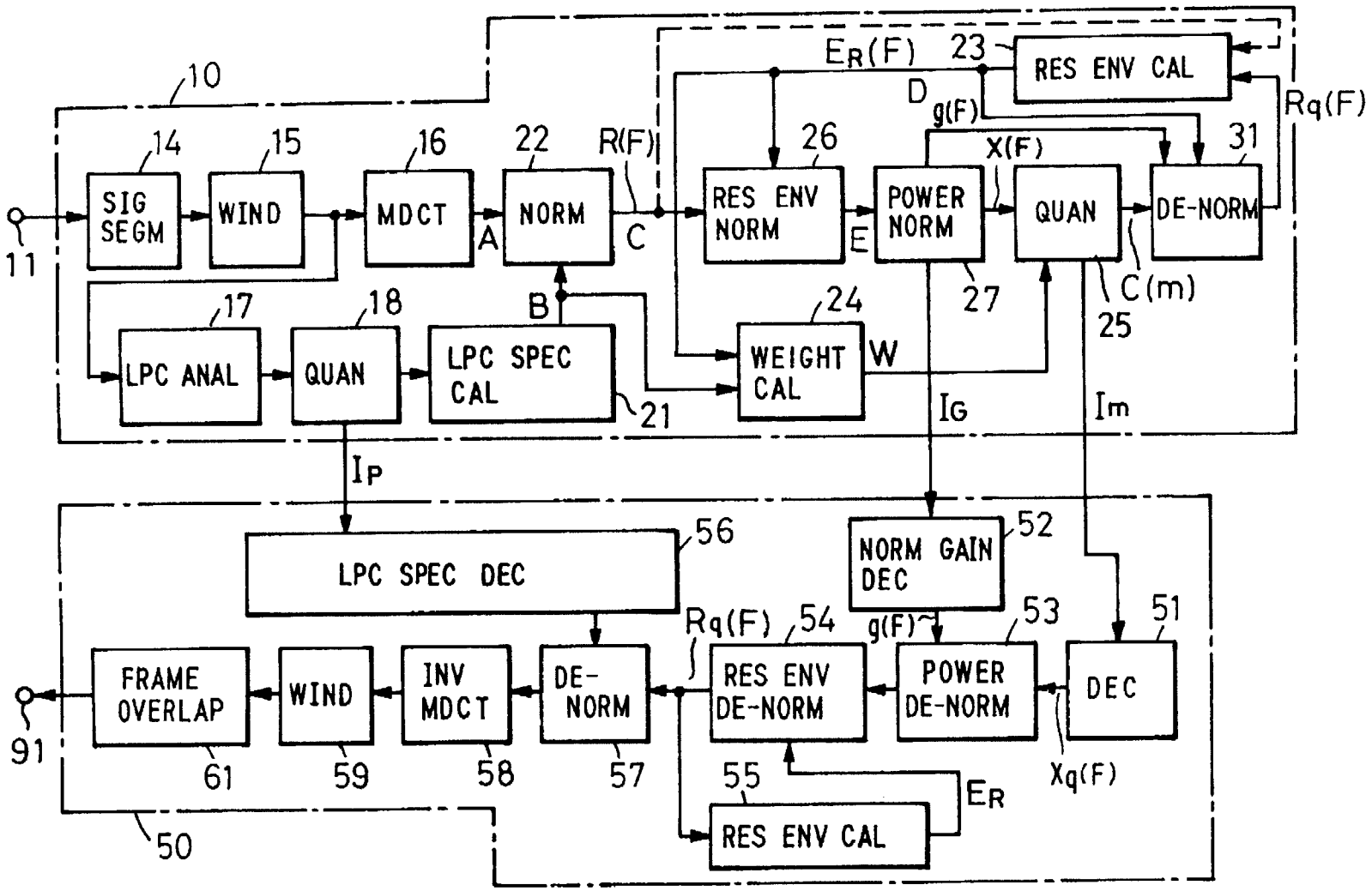
FIG. 3 is a block diagram illustrating examples of a coder and a decoder embodying the coding and decoding methods of the present invention.

FIG. 3 illustrates in block form a coder 10 and a decoder 50 which embody the coding and the decoding method according to the present invention, respectively, and FIGS. 4A through 4E show examples of waveforms denoted by A, B, . . . , E in FIG. 3. Also in the present invention, upon application of an input acoustic signal, residual coefficients of a flattened envelope are calculated first so as to reduce the number of bits necessary for coding the input signal; two methods such as mentioned below are available therefor.

(a) The input signal is transformed into frequency-domain coefficients, then the spectrum envelope of the input signal is calculated and the frequency-domain coefficients are normalized or flattened with the spectrum envelope to obtain the residual coefficients.

(b) The input signal is processed in the time domain by an inverse filter which is controlled by linear prediction coefficients to obtain a residual signal, which is transformed into frequency-domain coefficients to obtain the residual coefficients.

In the method (a), there are the following three approaches to obtaining the spectrum envelope of the input signal.

(c) The linear prediction coefficients of the input signal is Fourier-transformed to obtain its spectrum envelope.

Figure 1:
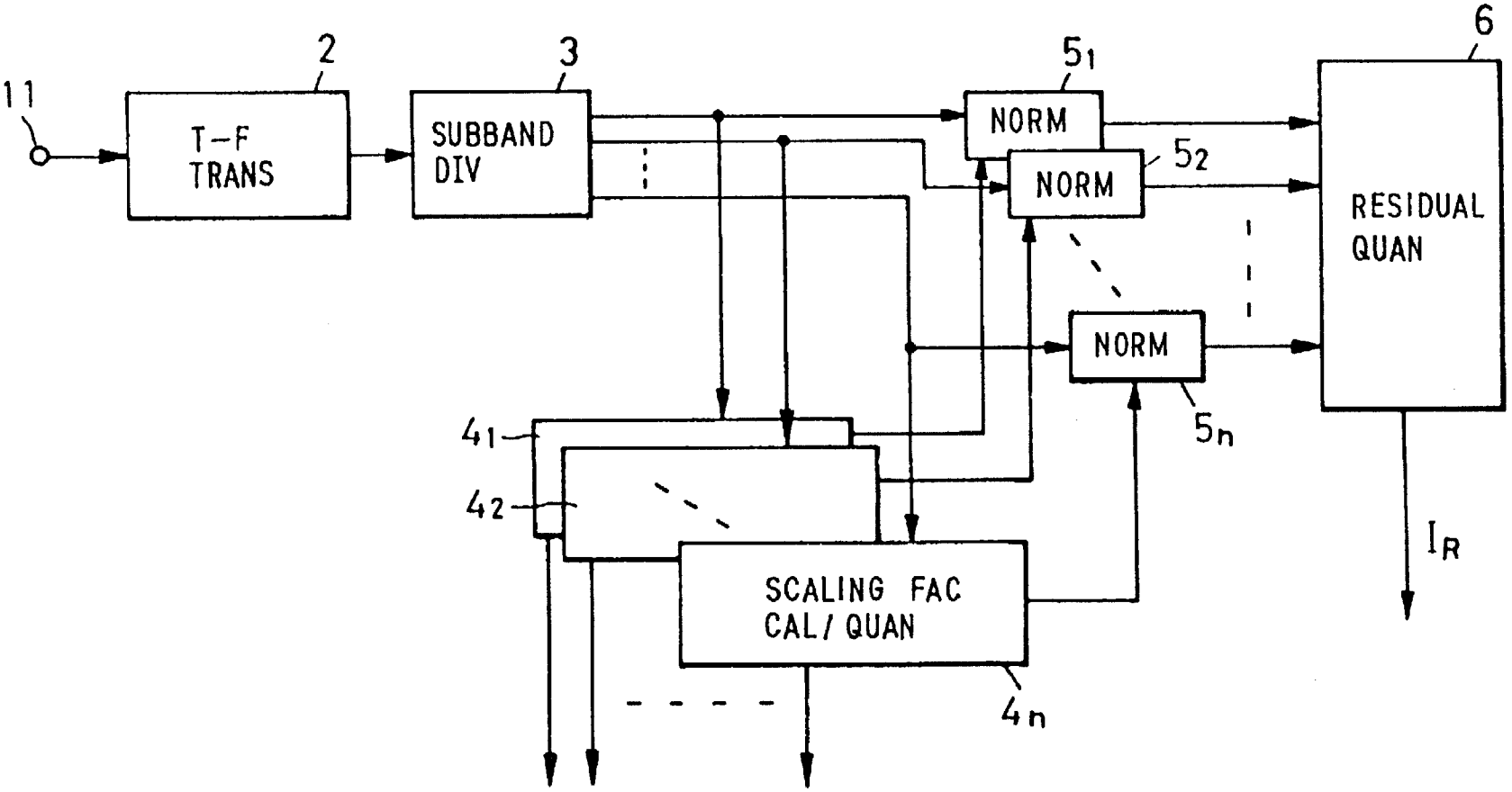
FIG. 1 PRIOR ART
FIG. 1 is a block diagram showing a conventional coder of the type that flattens the frequency characteristics of an input signal through use of scaling factors.
Figure 2:
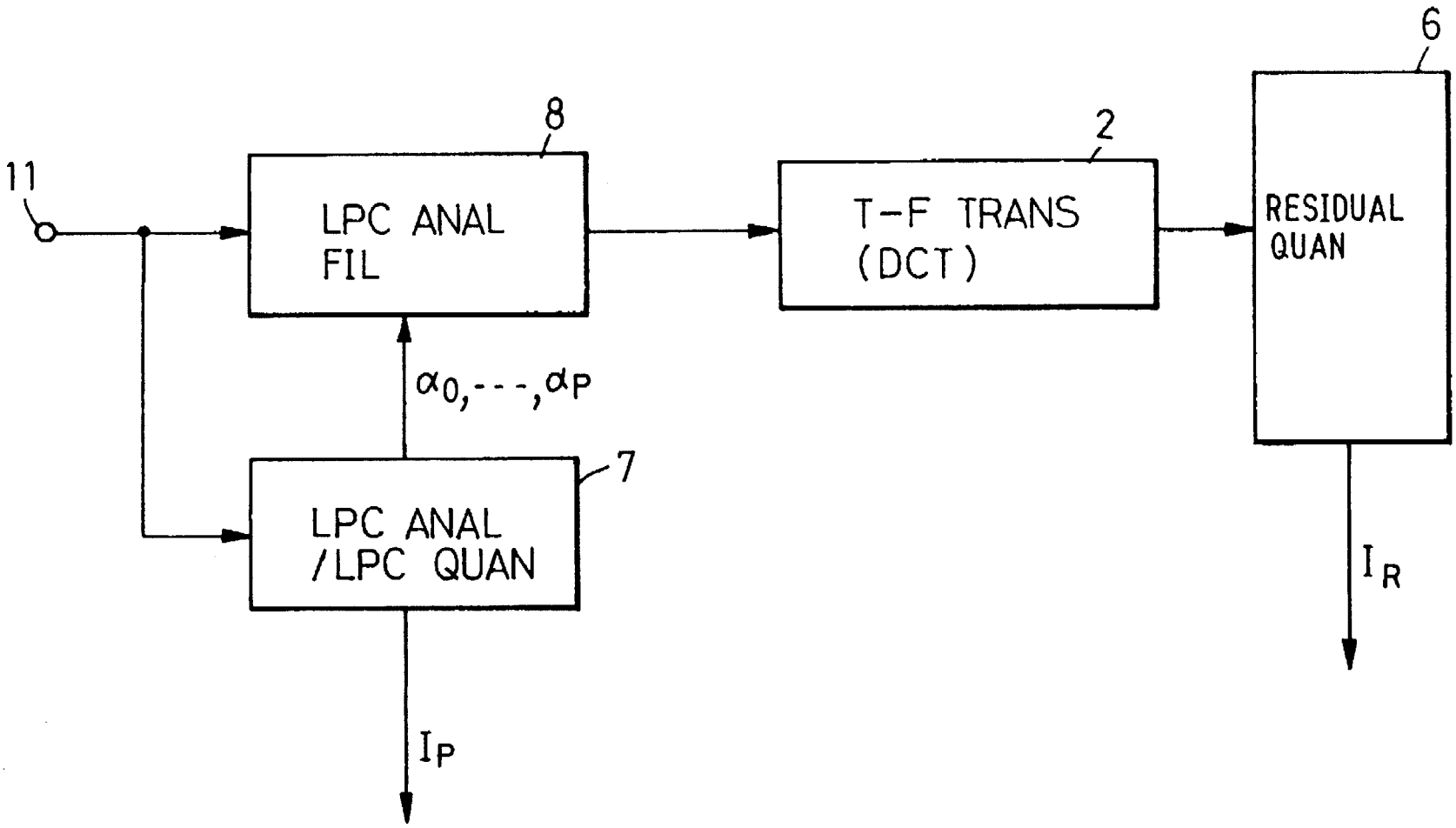
FIG. 2 PRIOR ART
FIG. 2 is a block diagram showing another conventional coder of the type that flattens the frequency characteristics of an input signal by a linear predictive coding analysis filter.

(d) In the same manner as described previously with respect to FIG. 1, the frequency-domain coefficients transformed from the input signal are divided into a plurality of bands and the scaling factors of the respective bands are used to obtain the spectrum envelope.

(e) Linear prediction coefficients of a time-domain signal, obtained by inverse transformation of absolute values of the frequency-domain coefficients transformed from the input signal, are calculated, and the linear prediction coefficients are Fourier-transformed to obtain the spectrum envelope.

The approaches (c) and (e) are based on the following fact. As referred to previously, the linear prediction coefficients represent the impulse response of an inverse filter that operates in such a manner as to flatten the frequency characteristics of the input signal; hence, the spectrum envelope of the linear prediction coefficients correspond to the spectrum envelope of the input signal. To be precise, the spectrum amplitude that is obtained by the Fourier transform of the linear prediction coefficients is the reciprocal of the spectrum envelope of the input signal.

In the present invention the method (a) may be combined with any of the approaches (c), (d) and (e), or only the method (b) may be used singly. The FIG. 3 embodiment show the case of the combined use of the methods (a) and (c). In a coder 10 an acoustic signal in digital form is input from the input terminal 11 and is provided first to a signal segmentation part 14, wherein an input sequence composed of 2N previous samples is extracted every N samples of the input signal, and the extracted input sequence is used as a frame for LOT (Lapped Orthogonal Transform) processing. The frame is provided to a windowing part 15, wherein it is multiplied by a window function. The lapped orthogonal transform is described, for example, in H. S. Malvar, "Signal Processing with Lapped Transform," Artech House. A value W(n) of the window function n-th from zeroth, for instance, is usually given by the following equation, and this embodiment uses it.

$$W(n)=\sin\{(\pi(n+0.5)/(2N)\} \quad (1)$$

Figure 4A:
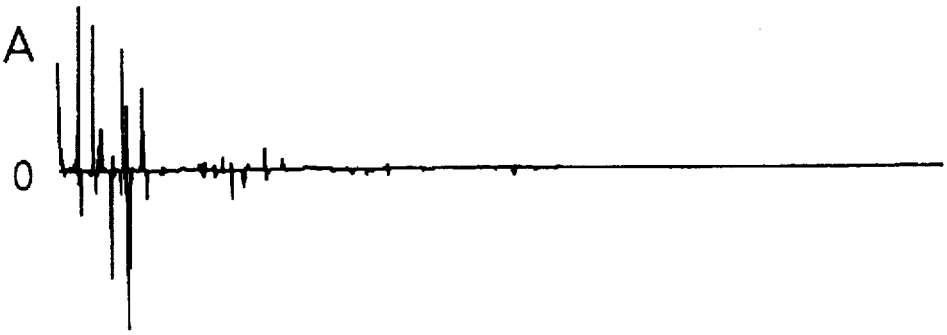
FIG. 4A shows an example of the waveform of frequency-domain coefficients obtained in an MDCT part 16 in FIG. 3.

The signal thus multiplied by the window function is fed to an MDCT (Modified Discrete Cosine Transform) part 16, wherein it is transformed to frequency-domain coefficients (sample values at respective points on the frequency axis) by N-order modified discrete cosine transform processing which is a kind of the lapped orthogonal transform; by this, spectrum amplitudes such as shown in FIG. 4A are obtained. At the same time, the output from the windowing part 15 is fed to an LPC (Linear Predictive Coding) analysis part 16, wherein it is subjected to a linear predictive coding analysis to generate P-order prediction coefficients $\alpha_0, \ldots, \alpha_p$. The prediction coefficients $\alpha_0, \ldots, \alpha_p$ are provided to a quantization part 18, wherein they are quantized after being transformed to, for instance, LSP parameters or k parameters, and an index $I_p$ indicating the spectrum envelope of the prediction parameters is produced.

Figure 4B:
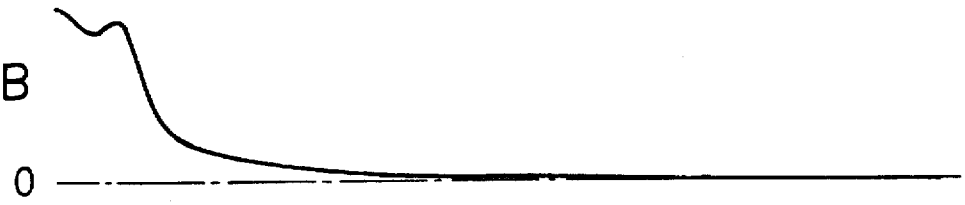
FIG. 4B shows an example of a spectrum envelope calculated in an LPC spectrum envelope calculation part 21 in FIG. 3.
Figure 5A:
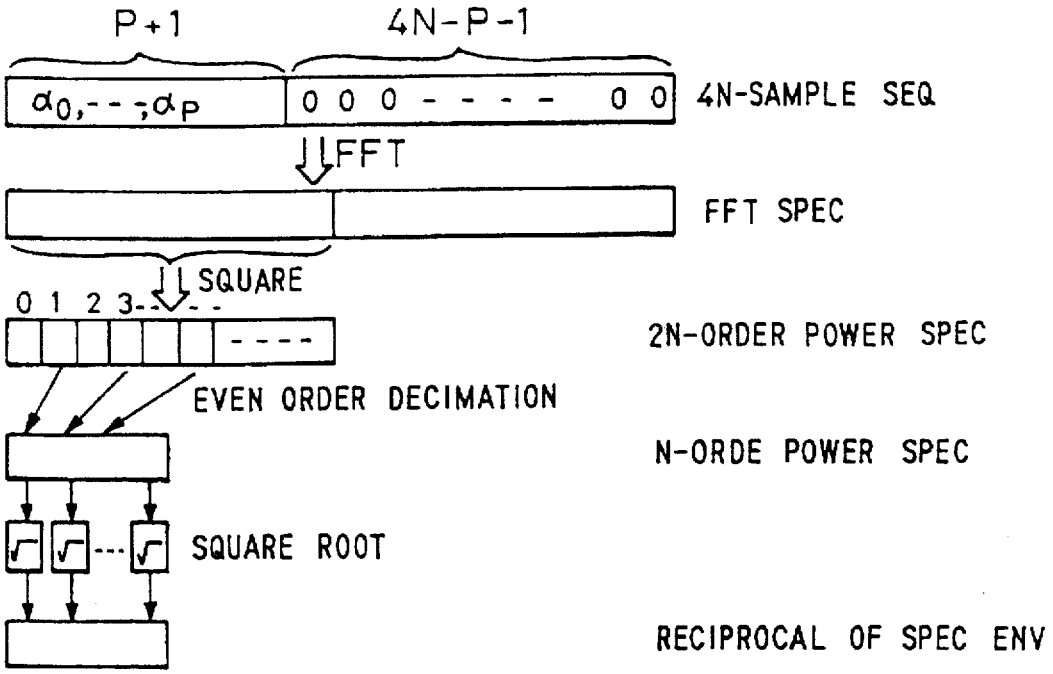
FIG. 5A is a diagram showing a method of obtaining the envelope of frequency characteristics from prediction coefficients.

The spectrum envelope of the LPC parameters $\alpha_0, \ldots, \alpha_p$ is calculated in an LPC spectrum envelope calculation part 21. FIG. 4B shows an example of the spectrum envelope thus obtained. The spectrum envelope of the LPC coefficients is generated by such a method as depicted in FIG. 5A. That is, a 4×N long sample sequence, which is composed of P+1 quantized prediction coefficients (α parameters) followed by (4×N−P−1) zeros, is subjected to discrete Fourier processing (fast Fourier transform processing, for example), then its 2×N order power spectrum is calculated, from which odd-number order components of the spectrum are extracted, and their square roots are calculated. The spectrum amplitudes at N points thus obtained represent the reciprocal of the spectrum envelope of the prediction coefficients.

Figure 5B:
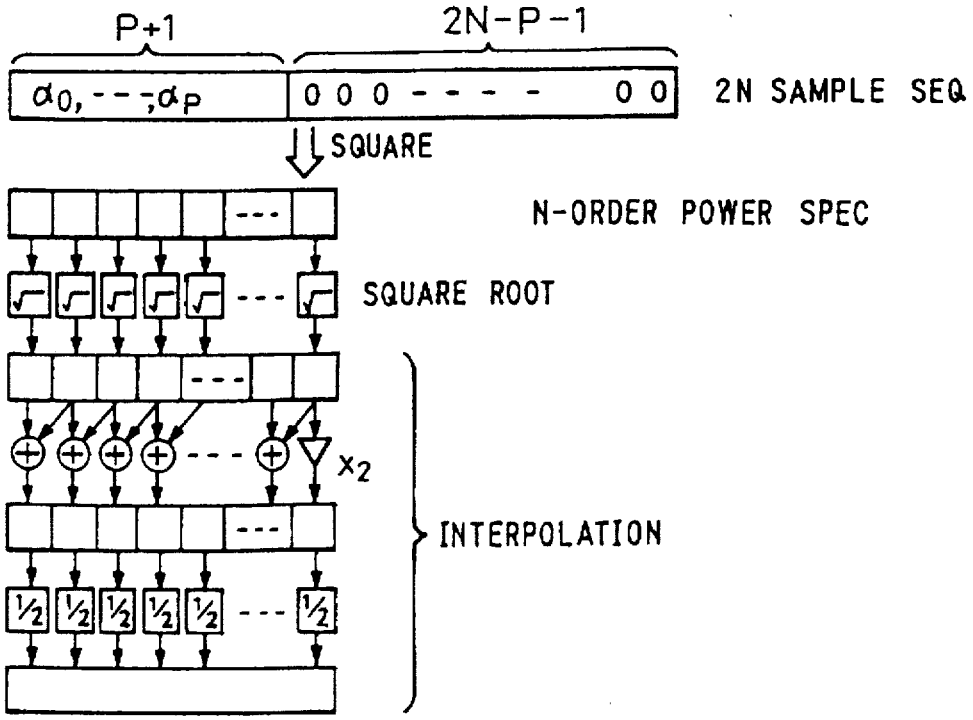
FIG. 5B is a diagram showing another method of obtaining the envelope of frequency characteristics from prediction coefficients.

Alternatively, as shown in FIG. 5B, a 2×N long sample sequence, which is composed of P+1 quantized prediction coefficients (α parameters) followed by (2×N−P−1) zeros, is FFT analyzed and N-order power spectrums of the results of the analysis are calculated. The reciprocal of the spectrum envelope i-th from zeroth is obtained by averaging the square roots of (i+1)th and i-th power spectrums, that is, by interpolation with them, except for i=N−1.

Figure 4C:
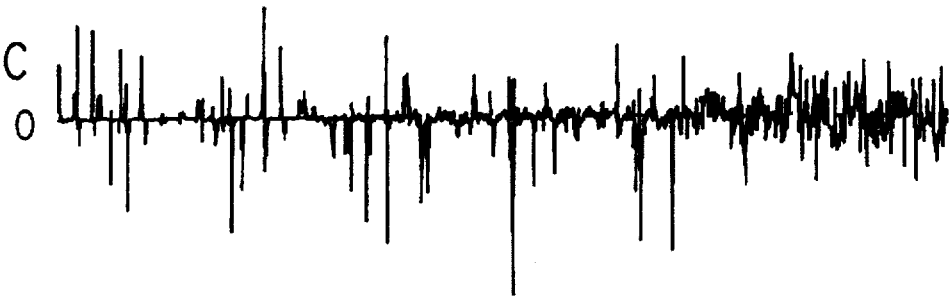
FIG. 4C shows an example of residual coefficients calculated in a flattening part 22 in FIG. 3.

In a flattening or normalization part 22, the thus obtained spectrum envelope is used to flatten or normalize the spectrum amplitudes from the MDCT part 16 by dividing the latter by the former for each corresponding sample, and the result of this, residual coefficients R(F) of the current frame F such as shown in FIG. 4C are generated. Incidentally, it is the reciprocal of the spectrum envelope that is obtained directly by the Fourier transform processing of the quantized prediction coefficients α, as mentioned previously; hence, in practice, the normalization part 22 needs only to multiply the output from the MDCT part 16 and the output from the LPC spectrum envelope calculation part 21 (the reciprocal of the spectrum envelope). In the following description, too, it is assumed, for convenience's sake, that the LPC spectrum envelope calculation part 21 outputs the spectrum envelope.

Conventionally, the residual coefficients obtained by a method different from the above-described method are quantized and the index indicating the quantization is sent out; the residual coefficients of acoustic signals (speech and music signals, in particular) usually contain relatively large fluctuations such as pitch components as shown in FIG. 4C. In view of this, according to the present invention, an envelope $E_R(F)$ of the residual coefficients R(F) in the current frame, predicted on the basis of the residual coefficients of the past or current frame, is used to normalize the residual coefficients R(F) of the current frame F to obtain fine structure coefficients, which are quantized. In this embodiment, the fine structure coefficients obtained by normalization are subjected to weighted quantization processing which is carried out in such a manner that the higher the level is, the greater importance is attached to the component. In a weighting factors calculation part 24 the spectrum envelope from the LPC spectrum envelope calculation part 21 and residual-coefficients spectrum $E_R(F)$ from a residual-coefficients calculation part 23 are multiplied for each corresponding sample to obtain weighting factors $w_1, \ldots, w_N$ (indicated by a vector W(F)), which are provided to a quantization part 25. It is also possible to control the weighting factors in accordance with a psycho-acoustic model. In this embodiment, a constant about 0.6 is exponentiated on the weighting factors. Another psycho-acoustic control method is one that is employed in the MPEG-Audio system; the weighting factors are multiplied by a non-logarithmic version of the SN ratio necessary for each sample obtained using a psycho-acoustic model. With this method, the minimum SN ratio at which noise can be detected psycho-acoustically for each frequency sample is calculated on the basis of the frequency characteristics of the input signal by estimating the amount of masking through use of the psycho-acoustic model. This SN ratio is needed for each sample. The psycho-acoustic model technology in the MPEG-Audio system is described in ISO/IEC Standards IS-11172-3.

In a signal normalization part 26 the residual coefficients R(F) of the current frame F, provided from the normalization part 22, are divided by the predicted residual-coefficient envelope $E_R(F)$ from the residual-coefficients envelope calculation part 23 to obtain fine structure coefficients. The fine structure coefficients of the current frame F are fed to a power normalization part 27, wherein they are normalized by being divided by a normalization gain g(F) which is the square root of an average value of their amplitudes or power, and normalized fine structure coefficients $X(F)=(x_1, \ldots, x_N)$ are supplied to a quantization part 25. The normalization gain g(F) for the power normalization is provided to a power de-normalization part 31 for inverse processing of normalization, while at the same time it is quantized, and an index $I_G$ indicating the quantized gain is outputted from the power normalization part 27.

In the quantization part 25 the normalized fine structure coefficients X(F) are weighted using the weighting factors W and then vector-quantized; in this example, they are subjected to interleave-type weighted vector quantization processing. At first, a sequence of normalized fine structure coefficients $x_j$ (j=1, . . . , N) and a sequence of weighting factors $w_j$ (j=1, . . . , N), each composed of N samples, are rearranged by interleaving to M subsequences each composed of N/M samples. The relationships between i-th sample values $x^k_i$ and $w^k_i$ of k-th subsequences and j-th sample values $x_j$ and $w_j$ of the original sequences are expressed by the following equation (2)

$$x^k_i=x_{iM+k},\ w^k_i=w_{iM+k} \tag{2}$$

That is, they bear a relationship j=iM+k, where k=0, 1, . . . , M−1 and i=0, 1, . . . , (N/M)−1.

Figure 6:
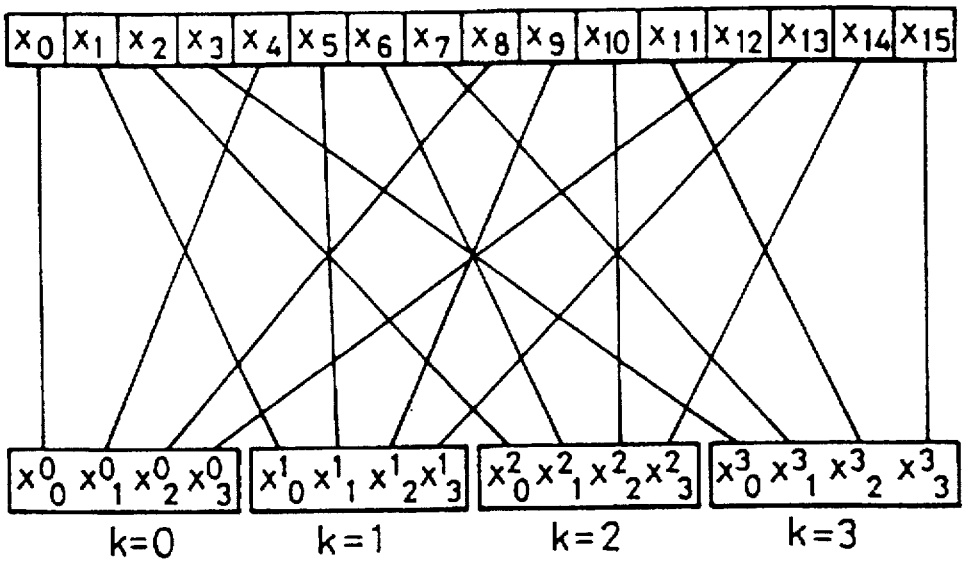
FIG. 6 is a diagram showing an example of the relationship between a signal sequence and subsequences in vector quantization.

FIG. 6 shows how the sequence of normalized fine structure coefficients $x_j$ (j=1, . . . , N) is rearranged to subsequences by the interleave method of Eq. (2) when N=16 and M=4. The sequence of weighting factors $w_j$ are also similarly rearranged to subsequences. M subsequence pairs of fine structure coefficients and weighting factors are each subjected to a weighted vector quantization. Letting the sample value of a k-th subsequence fine structure coefficient after interleaving be represented by $x^k_i$, the value of a k-th subsequence weighting factor by $w^k_i$ and the value of an i-th element of the vector C(m) of an index m of a codebook by $c_i(m)$, a weighted distance scale $d^k(m)$ in the vector quantization is defined by the following equation:

$$d^k(m)=\Sigma[w^k_i\{x^k_i-c_i(m)\}]^2 \tag{3}$$

where Σ is an addition operator from i=0 to (N/M)−1. A search for a code vector $C(m^k)$ that minimizes the distance scale $d^k(m)$ is made for k=1, . . . , M, by which a quantization index $I_m$ is obtained on the basis of indexes $m^1, \ldots m^M$ of respective code vectors.

Figure 7:
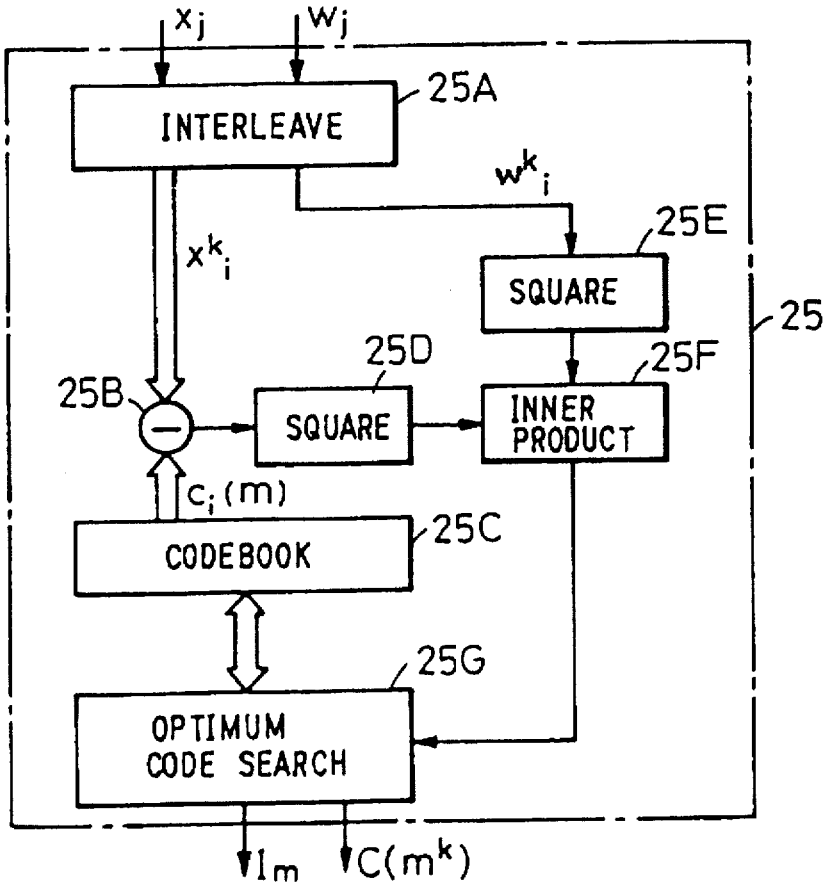
FIG. 7 is a block diagram illustrating an example of a quantization part 25 in FIG. 3.

FIG. 7 illustrates the construction of the quantization part 25 which performs the above-mentioned interleave-type weighted vector quantization. A description will be given, with reference to FIG. 7, of the quantization of the k-th subsequence $x^k_i$. In an interleave part 25A the input fine structure coefficients $x_j$ and the weighting factors $w_j$ (j=1, . . . , N) are rearranged as expressed by Eq. (2), and k-th subsequences $x^k_i$ and $w^k_i$ are provided to a subtraction part 25B and a squaring part 25E, respectively. The difference between an element sequence $c_i(m)$ of a vector C(m) selected from a codebook 25C and the fine structure coefficient subsequence $x^k_i$ is calculated in the subtraction part 25B, and the difference is squared by a squaring part 25D. On the other hand, the weighting factor subsequence $w^k_i$ is squared by the squaring part 25E, and the inner product of the outputs from the both squaring parts 25E and 25D is calculated in an inner product calculation part 25F. In an optimum code search part 25G the codebook 25C is searched for the vector $C(m^k)$ that minimizes the inner product value $d^k_i$, and an index $m^k$ is outputted which indicates the vector $C(m^k)$ that minimizes the inner product value $d^k_i$.

In this way, the quantized subsequence C(m) which is an element sequence forming M vectors $C(m^1)$, $C(m^2)$, . . . , $C(m^M)$, obtained by quantization in the quantization part 25, is rearranged to the original sequence of quantized normalized fine structure coefficients in the de-normalization part 31 following Eq. (2), and the quantized normalized fine structure coefficients are de-normalized (inverse processing of normalization) with the normalization gain g(F) obtained in the power normalization part 27 and, furthermore, they are multiplied by the residual-coefficients envelope from the residual-coefficients envelope calculation part 23, whereby quantized residual coefficients $R_q(F)$ are regenerated. The envelope of the quantized residual coefficients is calculated in the residual-coefficients envelope calculation part 23.

Figure 8:
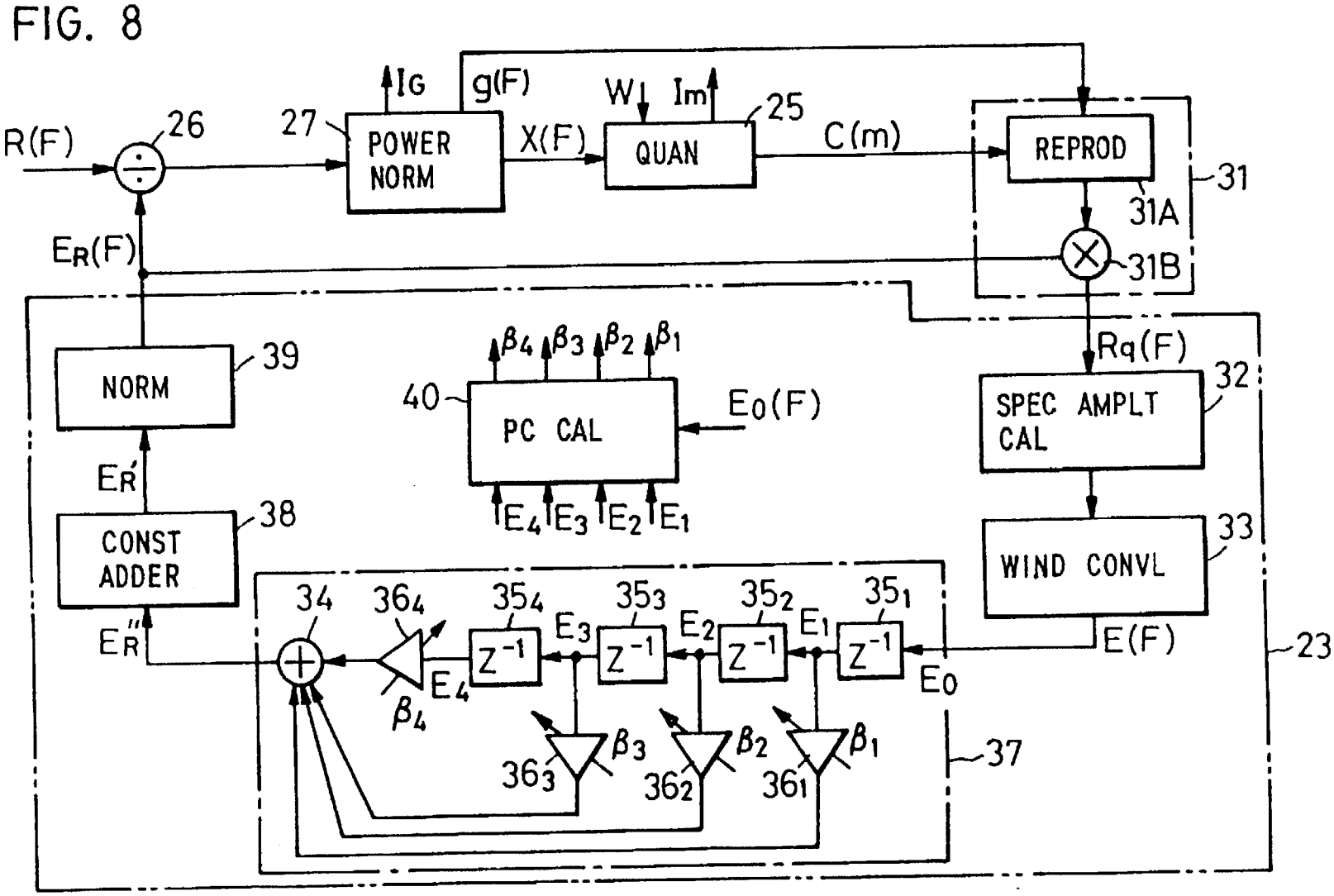
FIG. 8 is a block diagram illustrating a specific operative example of a residual-coefficients envelope calculation part 23 (55) in FIG. 3.

Referring now to FIG. 8, a specific operative example of the residual-coefficients envelope calculation part 23 will be described. In this example, the residual-coefficients R(F) of the current frame F, inputted into the residual-coefficients normalization part 26, is normalized with the residual-coefficients envelope $E_R(F)$ which is synthesized in the residual-coefficients envelope calculation part 23 on the basis of prediction coefficients $\beta_1(F-1)$ through $\beta_4(F-1)$ determined using residual coefficients R(F−1) of the immediately preceding frame F−1. A linear combination part 37 of the residual-coefficients envelope calculation part 23 comprises, in this example, four cascade-connected one-frame delay stages $35_1$ to $35_4$, multipliers $36_1$ to $36_4$ which multiply the outputs $E_1$ to $E_4$ from the delay stages $35_1$ to $35_4$ by the prediction coefficients $\beta_1$ to $\beta_4$, respectively, and an adder 34 which adds corresponding samples of all multiplied outputs and outputs the added results as a combined residual-coefficients envelope $E_R''(F)$ (N samples). In the current frame F the delay stages $35_1$ to $35_4$ yield, as their outputs $E_L(F)$ to $E_4(F)$, residual-coefficients spectrum envelopes E(F−1) to E(F−4) measured in previous frames (F−1) to (F−4), respectively; the prediction coefficients $\beta_1$ to $\beta_4$ are set to values $\beta_1(F-1)$ to $\beta_4(F-1)$ determined in the previous frame (F−1). Accordingly, the output $E_R''$ from the adder 34 in the current frame is expressed by the following equation.

$$E_R''=\beta_1(F-1)E(F-1)+\beta_2(F-1)E(F-2)+\ldots+\beta_4(F-1)E(F-4)$$

In the FIG. 8 example, the output $E_R''$ from the adder 34 is provided to a constant addition part 38, wherein the same constant is added to each sample to obtain a predicted residual-coefficient envelope $E_R'$. The reason for the addition of the constant in the constant addition part 38 is to limit the effect of a possible severe error in the prediction of the predicted residual-coefficients envelope $E_R$ that is provided as the output from the adder 34. The constant that is added in the constant addition part 38 is set to such a value that is the average power of one frame of the output from the adder 34 multiplied by 0.05, for instance; when the average amplitude of the predicted residual-coefficients envelope $E_R$ provided from the adder 34 is 1024, the above-mentioned constant is set to 50 or so. The output $E_R'$ from the constant addition part 38 is normalized, as required, in a normalization part 39 so that the power average of one frame (N points) becomes one, whereby the ultimate predicted residual-coefficients envelope $E_R(F)$ of the current frame F (which will hereinafter be referred to merely as a residual-coefficients envelope, too) is obtained.

Figure 4D:
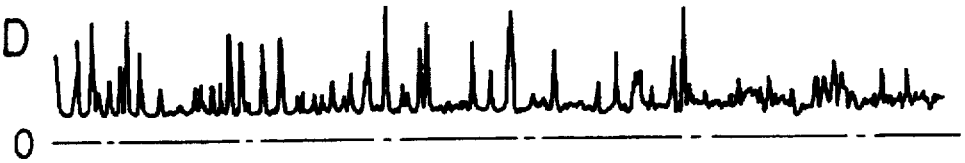
FIG. 4D shows an example of residual coefficients calculated in a residual-coefficients envelope calculation part 23.
Figure 4E:
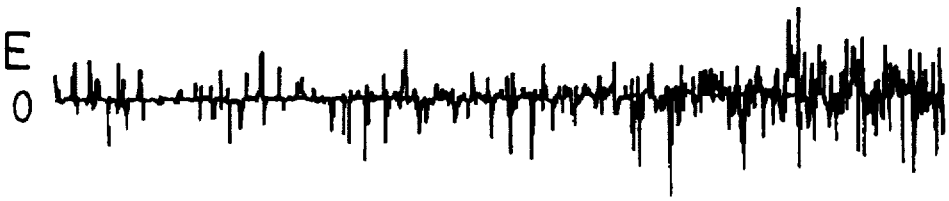
FIG. 4E shows an example of fine structure coefficients calculated in a residual-coefficients envelope flattening part 26 in FIG. 3.

The residual-coefficients envelope $E_R(F)$ thus obtained has, as shown in FIG. 4D, for example, unipolar impulses at the positions corresponding to high-intensity pitch components contained in the residual coefficients R(F) from the normalization part 22 depicted in FIG. 4C. In audio signals, since there is no appreciable difference in the frequency position between pitch components in adjacent frames, it is possible, by dividing the input residual-coefficient signal R(F) by the residual-coefficients envelope $E_R(F)$ in the residual-coefficients signal normalization part 26, to suppress the pitch component levels, and consequently, fine structure coefficients composed principally of random components as shown in FIG. 4E are obtained. The fine structure coefficients thus produced by the normalization are processed in the power normalization part 27 and the quantization part 25 in this order, from which the normalization gain g(F) and the quantized subsequence vector C(m) are provided to the power de-normalization part 31. In the power de-normalization part 31, the quantized subsequence vector C(m) is fed to a reproduction part 31A, wherein it is rearranged to reproduce quantized normalized fine structure coefficients $X_q(F)$. The reproduced output from the reproduction part 31A is fed to a multiplier 31B, wherein it is multiplied by the residual-coefficient envelope $E_R(F)$ of the current frame F to reproduce the quantized residual coefficients $R_q(F)$. In the current frame F the thus reproduced quantized residual coefficients (the reproduced residual coefficients) $R_q(F)$ are provided to a spectrum amplitude calculation part 32 of the residual-coefficients envelope calculation part 23.

The spectrum amplitude calculation part 32 calculates the spectrum amplitudes of N samples of the reproduced quantized residual coefficients $R_q(F)$ from the power de-normalization part 31. In a window function convolution part 33 a frequency window function is convoluted to the N calculated spectrum amplitudes to produce the amplitude envelope of the reproduced residual coefficients $R_q(F)$ of the current frame, that is, the residual-coefficients envelope E(F), which is fed to the linear combination part 37. In the spectrum amplitude calculation part 32, absolute values of respective samples of the reproduced residual coefficients $R_q(F)$, for example, are provided as the spectrum amplitudes, or square roots of the sums of squared values of respective samples of the reproduced residual coefficients $R_q(F)$ and squared values of the corresponding samples of residual coefficients $R_q(F-1)$ of the immediately previous frame (F−1) are provided as the spectrum amplitudes. The spectrum amplitudes may also be provided in logarithmic form. The window function in the convolution part 33 has a width of 3 to 9 samples and may be shaped as a triangular, Hamming, Hanning or exponential window, besides it may be made adaptively variable. In the case of using the exponential window, letting g denote a predetermined integer equal to or greater than 1, the window function may be defined by the following equation, for instance.

$$a^{|i|};\ i=-g, -(g-1), \ldots, -1, 0, 1, \ldots, (g-1), g$$

where a=0.5, for example. The width of the window in the case of the above equation is 2g+1. By convolution of the window function, the sample value at each point on the frequency axis is transformed to a value influenced by g sample values adjoining it in the positive direction and g sample values adjoining it in the negative direction. This prevents that the effect of the prediction of the residual-coefficients envelope in the residual-coefficients envelope calculation part 23 from becoming too sensitive. Hence, it is possible to suppress the generation of an abnormal sound in the decoded sound. When the width of the window exceeds 12 samples, fluctuations by pitch components in the residual-coefficients envelope become unclear or disappear—this is not preferable.

The spectrum envelope E(F) generated by the convolution of the window function is provided as a spectrum envelope $E_0(F)$ of the current frame to the linear combination part 37 and to a prediction coefficient calculation part 40 as well. The prediction coefficient calculation part 40 is supplied with the input $E_0(F)$ to the linear combination part 37 and the outputs $E_1=E(F-1)$ to $E_4=E(F-4)$ from the delay stages $\mathbf{35}_1$ to $\mathbf{35}_4$ and adaptively determines the prediction coefficients $\beta_1(F)$ to $\beta_4(F)$ in such a manner as to minimize a square error of the output $E_R''$ from the adder 34 relative to the spectrum envelope $E_O(F)$ as will be described later on. After this, the delay stages $\mathbf{35}_1$ to $\mathbf{35}_4$ take thereinto spectrum envelopes $E_0$ to $E_3$ provided thereto, respectively, and output them as updated spectrum envelopes $E_1$ to $E_4$, terminating the processing cycle for one frame. On the basis of the output (the combined or composite residual-coefficients envelope) $E_R''$ provided from the adder 34 as described above, predicted residual-coefficients envelope $E_R(F+1)$ for residual coefficients R(F+1) of the next frame (F+1) are generated in the same fashion as described above.

The prediction coefficients $\beta_1$ to $\beta_4$ can be calculated in such a way as mentioned below. In FIG. 8 the prediction order is the four-order, but in this example it is made Q-order for generalization purpose. Let q represent a given integer that satisfies a condition $1 \leqq q \leqq Q$ and let the value of a prediction coefficient at a q-th stage be represented by $\beta_q$. Further, let prediction coefficients (multiplication coefficients) for the multipliers $\mathbf{36}_1$ to $\mathbf{36}_Q$ (Q=4) be represented by $\beta_1, \ldots, \beta_Q$, the coefficient sequence of the q-th stage output by a vector $E_q$, the outputs from the delay stages $\mathbf{35}_1$ to $\mathbf{35}_Q$ by $E_1, E_2, \ldots, E_Q$ and the coefficient sequence (the residual-coefficients envelope of the current frame) E(F) of the spectrum envelope from the window function convolution part 33 by a vector $E_0$. In this case, by solving the following simultaneous linear equations (5) for $\beta_1$ to $\beta_Q$ through use of a cross correlation function r which is given by the following equation (4), it is possible to obtain the prediction coefficients $\beta_1$ to $\beta_Q$ that minimize the square error (a prediction error) of the output $E_R''$ from the adder 34 relative to the spectrum envelope $E_0(F)$.

$$r_{i,j} = E_i \cdot E_j \tag{4}$$

$$\begin{bmatrix} r_{1,1} & r_{1,2} & \cdots & r_{1,Q} \\ r_{2,1} & r_{2,2} & \cdots & r_{2,Q} \\ \vdots & & \ddots & \vdots \\ r_{Q,1} & r_{Q,2} & \cdots & r_{Q,Q} \end{bmatrix} \begin{bmatrix} \beta_1 \\ \beta_2 \\ \vdots \\ \beta_Q \end{bmatrix} = \begin{bmatrix} r_{0,1} \\ r_{0,2} \\ \vdots \\ r_{0,Q} \end{bmatrix} \tag{5}$$

The previous frames that are referred to in the linear combination part 37 are not limited specifically to the four preceding frames but the immediately preceding frame alone or more preceding ones may also be used; hence, the number Q of the delay stages may be an arbitrary number equal to or greater than one.

As described above, according to the coding method employing the residual-coefficients envelope calculation part 23 shown in FIG. 8, the residual coefficients R(F) from the normalization part 22 are normalized by the residual-coefficients envelope $E_R(F)$ estimated from the residual coefficients of the previous frames, and consequently, the normalized fine structure coefficients have an envelope flatter than that of the residual coefficients R(F). Hence, the number of bits for their quantization can be reduced accordingly. Moreover, since the residual coefficients R(F) are normalized by the residual-coefficients envelope $E_R(F)$ predicted on the basis of the spectrum envelope E(F) generated by convoluting the window function to the spectrum-amplitude sequence of the residual coefficients in the window function convolution part 33, no severe prediction error will occur even if the estimation of the residual-coefficients envelope is displaced about one sample in the direction of the frequency axis relative to, for example, high-intensity pulses that appear at positions corresponding to pitch components in the residual coefficients R(F). When the window function convolution is not used, an estimation error will cause severe prediction errors.

In FIG. 3, the coder 10 outputs the index $I_p$ representing the quantized values of the linear prediction coefficients, the index $I_G$ indicating the quantized value of the power normalization gain g(F) of the fine structure coefficients and the index $I_m$ indicating the quantized values of the fine structure coefficients.

The indexes $I_p$, $I_G$ and $I_m$ are input into a decoder 50. In a decoding part 51 the normalized fine structure coefficients $X_q(F)$ are decoded from the index $I_m$, and in a normalization gain decoding part 52 the normalization gain g(F) is decoded from the quantization index $I_G$. In a power de-normalization part 53 the decoded normalized fine structure coefficients $X_q(F)$ are de-normalized by the decoded normalization gain g(F) to fine structure coefficients. In a de-normalization part 54 the fine structure coefficients are de-normalized by being multiplied by a residual-coefficients envelope $E_R$ provided from a residual-coefficients calculation part 55, whereby the residual coefficients $R_q(F)$ are reproduced.

On the other hand, the index $I_p$ is provided to an LPC spectrum decoding part 56, wherein it is decoded to generate the linear prediction coefficients $\alpha_0$ to $\alpha_p$, from which their spectrum envelope is calculated by the same method as that used in the spectrum envelope calculation part 21 in the coder 10. In a de-normalization part 57 the regenerated residual coefficients $R_q(F)$ from the de-normalization part 54 are de-normalized by being multiplied by the calculated spectrum envelope, whereby the frequency-domain coefficients are reproduced. In an IMDCT (Inverse Modified Discrete Cosine Transform) part 58 the frequency-domain coefficients are transformed to a 2N-sample time-domain signal (hereinafter referred to as an inverse LOT processing frame) by being subjected to N-order inverse modified discrete cosine transform processing for each frame. In a windowing part 59 the time-domain signal is multiplied every frame by a window function of such a shape as expressed by Eq. (1). The output from the windowing part 59 is provided to a frame overlapping part 61, wherein former N samples of the 2N-sample long current frame for inverse LOT processing and latter N samples of the preceding frame are added to each other, and the resulting N samples are provided as a reproduced acoustic signal of the current frame to an output terminal 91.

In the above, the values P, N and M can freely be set to about 60, 512 and about 64, respectively, but it is necessary that they satisfy a condition $P+1<N\times4$. While in the above embodiment the number M, into which the normalized fine structure coefficients are divided for their interleaved vector quantization as mentioned with reference to FIG. 6, has been described to be chosen such that the value N/M is an integer, the number M need not always be set to such a value. When the value N/M is not an integer, every subsequence needs only to be lengthened by one sample to compensate for the shortage of samples.

Figure 9:
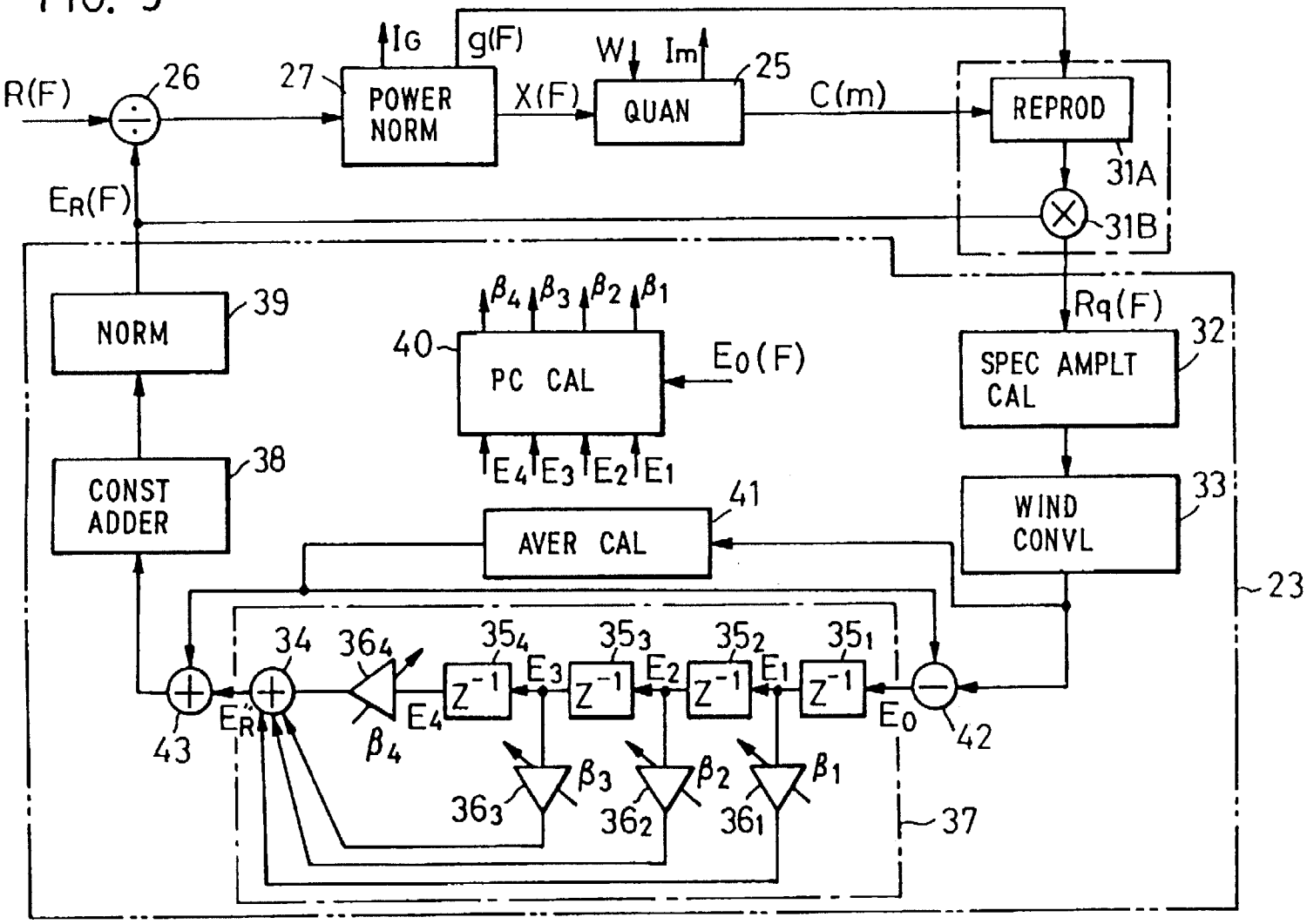
FIG. 9 is a block diagram illustrating a modified form of the residual-coefficients envelope calculation part 23 (55) depicted in FIG. 8.

FIG. 9 illustrates a modified form of the residual-coefficients envelope calculation part 23 (55) shown in FIG. 8. In FIG. 9 the parts corresponding to those in FIG. 8 are denoted by the same reference numerals. In FIG. 9, the output from the window function convolution part 33 is fed to an average calculation part 41, wherein the average of the output over 10 frames, for example, is calculated for each sample position or the average of one-frame output is calculated for each frame, that is, a DC component is detected. The result is subtracted by subtractor 42 from the output of the window function convolution part 33, then only the resulting fluctuation of the spectrum envelope is fed to the delay stage $\mathbf{35}_1$ and the output from the average calculation part 41 is added by an adder 43 to the output from the adder 34. The prediction coefficients $\beta_1$ to $\beta_Q$ are determined so that the output $E_R''$ from the adder 34 comes as close to the output $E_0$ from the subtractor 42 as possible. The prediction coefficients $\beta_1$ to $\beta_Q$ can be determined using Eqs. (4) and (5) as in the above-described example. The configuration of FIG. 9 predicts only the fluctuations of the spectrum envelope, and hence provides increased prediction efficiency.

Figure 10:
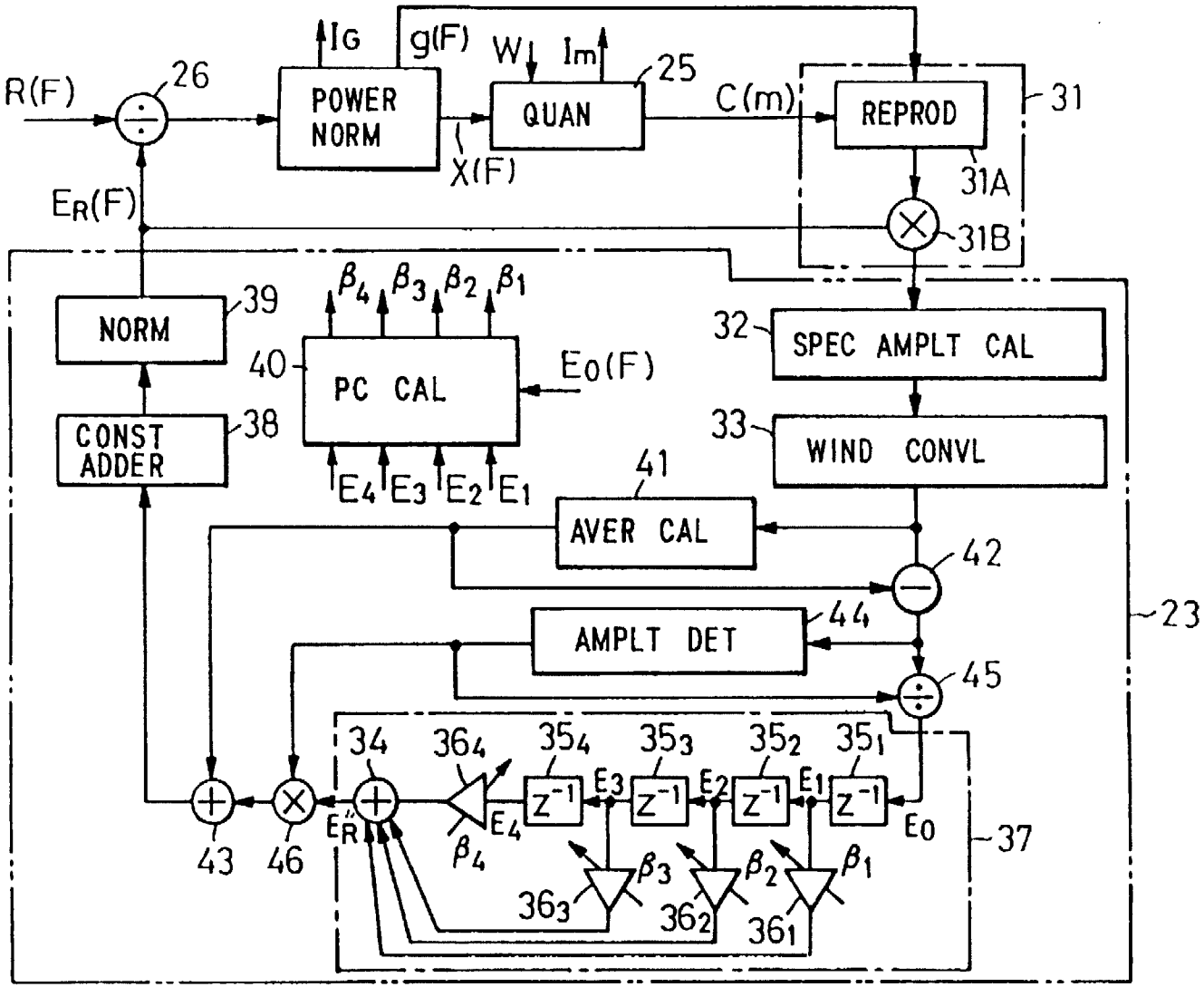
FIG. 10 is a block diagram illustrating a modified form of the residual-coefficients envelope calculation part 23 (55) shown in FIG. 9.

FIG. 10 illustrates a modification of the FIG. 9 example. In FIG. 10, an amplitude detection part 44 calculates the square root of an average value of squares (i.e., a standard deviation) of respective sample values in the current frame which are provided from the subtractor 42 in FIG. 9, and then the standard deviation is used in a divider 45 to divide the output from the subtractor 42 to normalize it and the resulting fluctuation-flattened spectrum envelope $E_0$ is supplied to the delay stage $\mathbf{35}_1$ and the prediction coefficients calculation part 40 the latter of which determines the prediction coefficients $\beta_1$ to $\beta_Q$ according to Eqs. (4) and (5) so that the output $E_R''$ from the adder 34 becomes as close as possible to the output $E_0$ from the divider 45: The output $E_R''$ from the adder 34 is applied to a multiplier 46, wherein it is de-normalized by being multiplied by the standard deviation which is the output from the amplitude detection part 44, and the de-normalized output is provided to the adder 43 to obtain the residual-coefficients envelope $E_R(F)$. In the example of FIG. 10, Eq. (5) for calculating the prediction coefficients $\beta_1$ to $\beta_Q$ in the FIG. 8 example can be approximated as expressed by the following equation (6).

$$\begin{bmatrix} r_0 & r_1 & \cdots & r_{Q-1} \\ r_1 & r_0 & \cdots & r_{Q-2} \\ \vdots & \vdots & \ddots & \vdots \\ r_{Q-1} & r_{Q-2} & \cdots & r_0 \end{bmatrix} \begin{bmatrix} \beta_1 \\ \beta_2 \\ \vdots \\ \beta_Q \end{bmatrix} = \begin{bmatrix} r_1 \\ r_2 \\ \vdots \\ r_Q \end{bmatrix} \tag{6}$$

where: $r_i=r_{0,i}$. That is, since the power of the spectrum envelope which is fed to the linear combination part 37 is normalized, diagonal elements $r_{1,1}, r_{2,2}, \ldots$ in the first term on the left-hand side of Eq. (5) become equal to each other and $r_{i,j}=r_{j,i}$. Since the matrix in Eq. (6) is the Toeplitz type, this equation can be solved fast by a Levinson-Durbin algorithm. In the examples of FIGS. 8 and 9, Q×Q correlation coefficients need to be calculated, whereas in the example of FIG. 10 only Q correlation coefficients need to be calculated, hence the amount of calculation for obtaining the prediction coefficients $\beta_1$ to $\beta_Q$ can be reduced accordingly. The correlation coefficient $r_{0,j}$ may be calculated as expressed by Eq. (4), but it becomes more stable when calculated by a method in which inner products of coefficient vectors $E_i$ and $E_{i+j}$ spaced j frames apart are added over the range from i=0 to $n_{MAX}$ as expressed by the following equation (7):

$$r_{0,j}=(1/S)\Sigma E_i \cdot E_{i+j} \tag{7}$$

where Σ is a summation operator from i=0 to $n_{MAX}$ and S is a constant for averaging use, where S≧Q. The value $n_{MAX}$ may be S−1 or (S−j−1) as well. The Levinson-Durbin algorithm is described in detail in Saito and Nakada, "The Foundations of Speech Information Processing," (Ohmsha).

In the FIG. 10 example, an average value of absolute values of the respective samples may be used instead of calculating the standard deviation in the amplitude detection part 44.

In the calculation of the prediction coefficients $\beta_1$ to $\beta_Q$ in the examples of FIGS. 8 and 9, the correlation coefficients $r_{i,j}$ can also be calculated by the following equation:

$$r_{i,j}=(1/S)\Sigma E_{n+1} \cdot E_{n+i+j} \tag{8}$$

where Σ is a summation operator from n=0 to $n_{MAX}$ and S is a constant for averaging use, where S≧Q. The value $n_{MAX}$ may be S−1 or S−j−1 as well. With this method, when S is sufficiently greater than Q, an approximation $r_{i,j}=r_{0,j}$ can be made and Eq. (5) for calculating the prediction coefficients can be approximated identical with Eq. (6) and can be solved fast by using the Levinson-Durbin algorithm.

While in the above the prediction coefficients $\beta_1$ to $\beta_Q$ for the residual-coefficients envelope in the residual-coefficients envelope calculation part 23 (55) are simultaneously determined over the entire band, it is also possible to use a method by which the input to the residual-coefficients envelope calculation part 23 (55) is divided into subbands and the prediction coefficients are set independently for each subband. In this case, the input can be divided into subbands with equal bandwidth in a linear, logarithmic or Bark scale.

Figure 11:
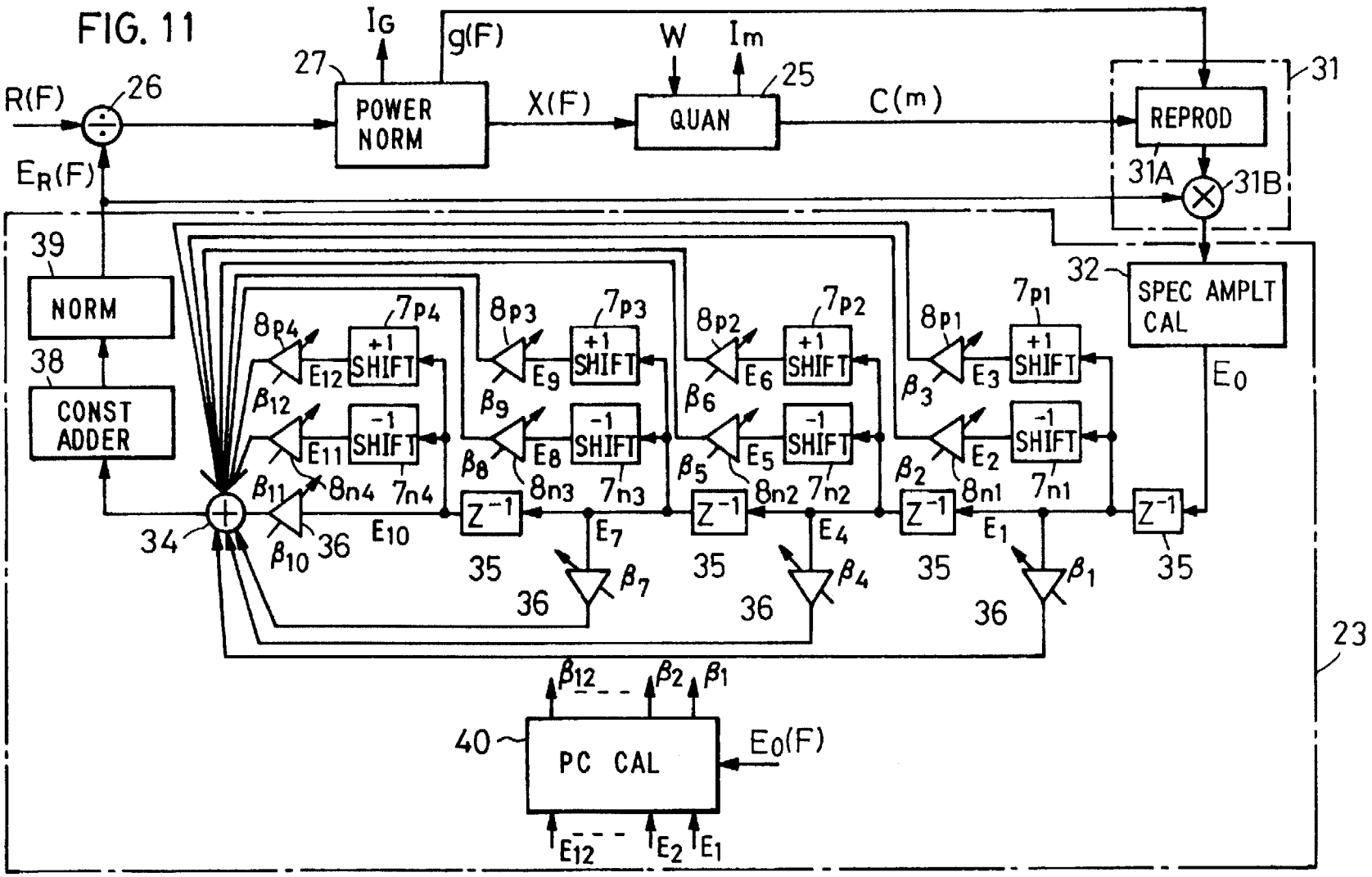
FIG. 11 is a block diagram illustrating an example which adaptively controls both a window function and prediction coefficients in the residual-coefficients envelope calculation part 23 (55) shown in FIG. 3.

With a view to lessening the influence of prediction errors in the prediction coefficients $\beta_1$ to $\beta_Q$ in the residual-coefficients envelope calculation part 23 (55), the width or center of the window in the window function convolution part 33 may be changed; in some cases, the shape of the window can be changed. Furthermore, the convolution of the window function and the linear combination by the prediction coefficients $\beta_1$ to $\beta_Q$ may also be performed at the same time, as shown in FIG. 11. In this example, the prediction order Q is 4 and the window width T is 3. The outputs from the delay stages $\mathbf{35}_1$ to $\mathbf{35}_4$ are applied to shifters $\mathbf{7}_{p1}$ to $\mathbf{7}_{p4}$ each of which shifts the input thereto one sample in the positive direction along the frequency axis and shifters $\mathbf{7}_{n1}$ to $\mathbf{7}_{n4}$ each of which shifts the input thereto one sample in the negative direction along the frequency axis. The outputs from the positive shifters $\mathbf{7}_{p1}$ to $\mathbf{7}_{p4}$ are provided to the adder 34 via multipliers $\mathbf{8}_{p1}$ to $\mathbf{8}_{p4}$, respectively, and the outputs from the negative shifters $\mathbf{7}_{n1}$ to $\mathbf{7}_{n4}$ are fed to the adder 34 via multipliers $\mathbf{8}_{p1}$ to $\mathbf{8}_{p4}$, respectively. Letting multiplication coefficients of the multipliers $\mathbf{36}_1$, $\mathbf{8}_{n1}$, $\mathbf{8}_{p1}$, $\mathbf{36}_2$, $\mathbf{8}_{n2}$, $\mathbf{8}_{p2}$, . . . , $\mathbf{8}_{p4}$ be represented by $\beta_1$, $\beta_2$, $\beta_3$, $\beta_4$, $\beta_5$, $\beta_6$, . . . , $\beta_u$ (u=12 in this example), respectively, their input spectrum envelope vectors by $E_1$, $E_2$, $E_3$, $E_4$, . . . , $E_u$, respectively, and the output from the spectrum amplitude calculation part 23 by $E_0$, the prediction coefficients $\beta_1$ to $\beta_u$ that minimize the square error of the output $E_R$ from the adder 34 relative to the output $E_0$ from the spectrum amplitude calculation part 32 can be obtained by solving the following linear equation (10) in the prediction coefficient calculation part 40.

$$r_{ij} = E_i E_j \tag{10}$$

$$\begin{bmatrix} r_{1,1} & r_{1,2} & \cdots & r_{1,u} \\ r_{2,1} & r_{2,2} & \cdots & r_{2,u} \\ \vdots & \vdots & & \vdots \\ r_{u,1} & r_{u,2} & \cdots & r_{u,u} \end{bmatrix} \begin{bmatrix} \beta_1 \\ \beta_2 \\ \vdots \\ \beta_u \end{bmatrix} = \begin{bmatrix} r_{0,1} \\ r_{0,2} \\ \vdots \\ r_{0,u} \end{bmatrix}$$

The output $E_R$ from the adder 34, which is provided on the basis of the thus determined prediction coefficients $\beta_1$ to $\beta_u$, is added with a constant, if necessary, and normalized to the residual-coefficients envelope $E_R(F)$ of the current frame as in the example of FIG. 8, and the residual-coefficients envelope $E_R(F)$ is used for the envelope normalization of the residual coefficients R(F) in the residual-coefficients envelope normalization part 26. Such adaptation of the window function can be used in the embodiments of FIGS. 9 and 10 as well.

Figure 12:
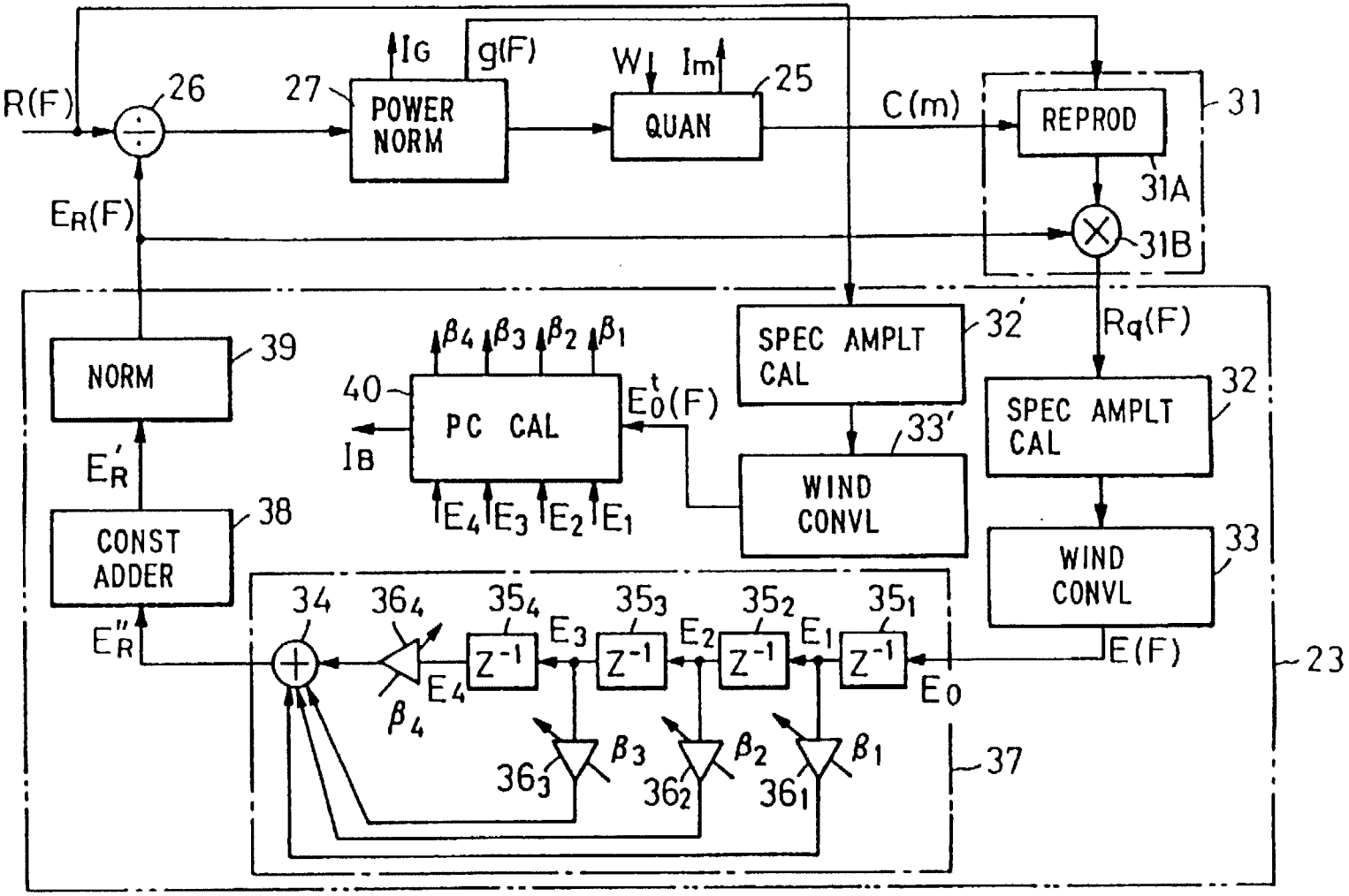
FIG. 12 is a block diagram illustrating still another example of the residual-coefficients envelope calculation part 23 in FIG. 3.

In the embodiments of FIGS. 3 and 8 through 11, the residual coefficients R(F) of the current frame F, fed to the normalization part 26, have been described to be normalized by the predicted residual-coefficients envelope $E_R(F)$ generated using the prediction coefficients $\beta_1(F-1)$ to $\beta_Q(F-1)$ (or $\beta_u$) determined in the residual-coefficients envelope calculation part 23 on the basis of the residual coefficients R(F−1) of the immediately preceding frame F−1. It is also possible to use a construction in which the prediction coefficients $\beta_1(F)$ to $\beta_Q(F)$ ($\beta_u$ in the case of FIG. 11 but represented by $\beta_Q$ in the following description) for the current frame are determined in the residual-coefficients envelope calculation part 23, the composite residual-coefficients envelope $E_R''(F)$ is calculated by the following equation $$E_R''(F)=\beta_1(F)E_1(F)+\beta_2(F)E_2(F)+\ldots+\beta_Q(F)E_Q(F)$$

and the resulting predicted residual-coefficients envelope $E_R(F)$ is used to normalize the residual coefficients R(F) of the current frame F. In this instance, as indicated by the broken line in FIG. 3, the residual coefficients R(F) of the current frame are provided directly from the normalization part 22 to the residual-coefficients envelope calculation part 23 wherein they are used to determine the prediction coefficients $\beta_1$ to $\beta_Q$. This method is applicable to the residual-coefficients envelope calculation part 23 in all the embodiments of FIGS. 8 through 11; FIG. 12 shows the construction of the part 23 embodying this method in the FIG. 8 example.

In FIG. 12 the parts corresponding to those in FIG. 8 are identified by the same reference numerals. This example differs from the FIG. 8 example in that another pair of spectrum amplitude calculation part 32' and window function convolution part 33' is provided in the residual-coefficients envelope calculation part 23. The residual coefficients R(F) of the current frame F are fed directly to the spectrum amplitude calculation part 32' to calculate their spectrum amplitude envelope, into which is convoluted with a window function in the window function convolution part 33' to obtain a spectrum envelope $E'_O(F)$, which is provided to the prediction coefficient calculation part 40. Hence, the spectrum envelope $E_O(F)$ of the current frame F, obtained from the reproduced residual coefficients $R_q(F)$, is fed only to the first delay stage $35_1$ of the linear combination part 37.

At first, the input residual coefficients R(F) of the current frame F, fed from the normalization part 22 (see FIG. 3) to the residual-coefficients envelope normalization part 26, are also provided to the pair of the spectrum amplitude calculation part 32' and the window function convolution part 33', wherein they are subjected to the same processing as in the pair of the spectrum amplitude calculation part 32 and the window function convolution part 33; by this, the spectrum envelope $E'_O(F)$ of the residual coefficients R(F) is generated and it is fed to the prediction coefficient calculation part 40. As in the case of FIG. 8, the prediction coefficient calculation part 40 uses Eqs. (4) and (5) to calculate the prediction coefficients $\beta_1$ to $\beta_5$ that minimize the square error of the output $E_R''$ from the adder 34 relative to the coefficient vector $E'_O$. The thus determined prediction coefficients $\beta_1$ to $\beta_4$ are provided to the multipliers $36_1$ to $36_4$ and the resulting output from the adder 34 is obtained as the composite residual-coefficients envelope $E_R''(F)$ of the current frame.

As in the case of FIG. 8, the composite residual-coefficients envelope $E_R''$ is similarly subjected to processing in the constant addition part 38 and the normalization part 39, as required, and is then provided as the residual-coefficients envelope $E_R(F)$ of the current frame to the residual-coefficient signal normalization part 26, wherein it is used to normalize the input residual coefficients R(F) of the current frame F to obtain the fine structure coefficients. As described previously with reference to FIG. 3, the fine structure coefficients are power-normalized in the power normalization part 27 and subjected to the weighted vector quantization processing; the quantization index $I_G$ of the normalization gain in the power normalization part 27 and the quantization index in the quantization part 25 are supplied to the decoder 50. On the other hand, the interleave type weighted vectors C(m) outputted from the quantization part 25 are rearranged and de-normalized by the normalization gain g(F) in the power de-normalization part 31. The resulting reproduced residual coefficients $R_q(F)$ are provided to the spectrum amplitude calculation part 32 in the residual-coefficients envelope calculation part 23, wherein spectrum amplitudes at N sample points are calculated. In the window function convolution part 33 the window function is convoluted into the residual-coefficients amplitudes to obtain the residual-coefficients envelope $E_O(F)$. This spectrum envelope $E_O(F)$ is fed as the input coefficient vectors $E_O$ of the current frame F to the linear combination part 37. The delay stages $35_1$ to $35_4$ take thereinto the spectrum envelopes $E_O$ to $E_3$, respectively, and output them as updated spectrum envelopes $E_1$ to $E_4$. Thus, the processing cycle for one frame is completed.

In the FIG. 12 embodiment, the prediction coefficients $\beta_1$ to $\beta_4$ are determined on the basis of the residual coefficients R(F) of the current frame F and these prediction coefficients are used to synthesize the predicted residual-coefficients envelope $E_R(F)$ of the current frame. In the decoder 50 shown in FIG. 3, however, the reproduced residual coefficients $R_q(F)$ of the current frame are to be generated in the residual envelope de-normalization part 54, using the fine structure coefficients of the current frame from the power de-normalization part 53 and the residual-coefficients envelope of the current frame from the residual-coefficients envelope calculation part 55; hence, the residual-coefficients envelope calculation part 55 is not supplied with the residual coefficients R(F) of the current frame for determining the prediction coefficients $\beta_1$ to $\beta_4$ of the current frame. Therefore, the prediction coefficients $\beta_1$ to $\beta_4$ cannot be determined using Eqs. (4) and (5). When the coder 10 employs the residual-coefficients envelope calculation part 23 of the type shown in FIG. 12, the prediction coefficients $\beta_1$ to $\beta_4$ of the current frame, determined in the prediction coefficient calculation part 40 of the coder 10 side, are quantized and the quantization indexes $I_B$ are provided to the residual-coefficients envelope calculation part 55 of the decoder 50 side, wherein the residual-coefficients envelope of the current frame is calculated using the prediction coefficients $\beta_1$ to $\beta_4$ decoded from the indexes $I_B$.

Figure 13:
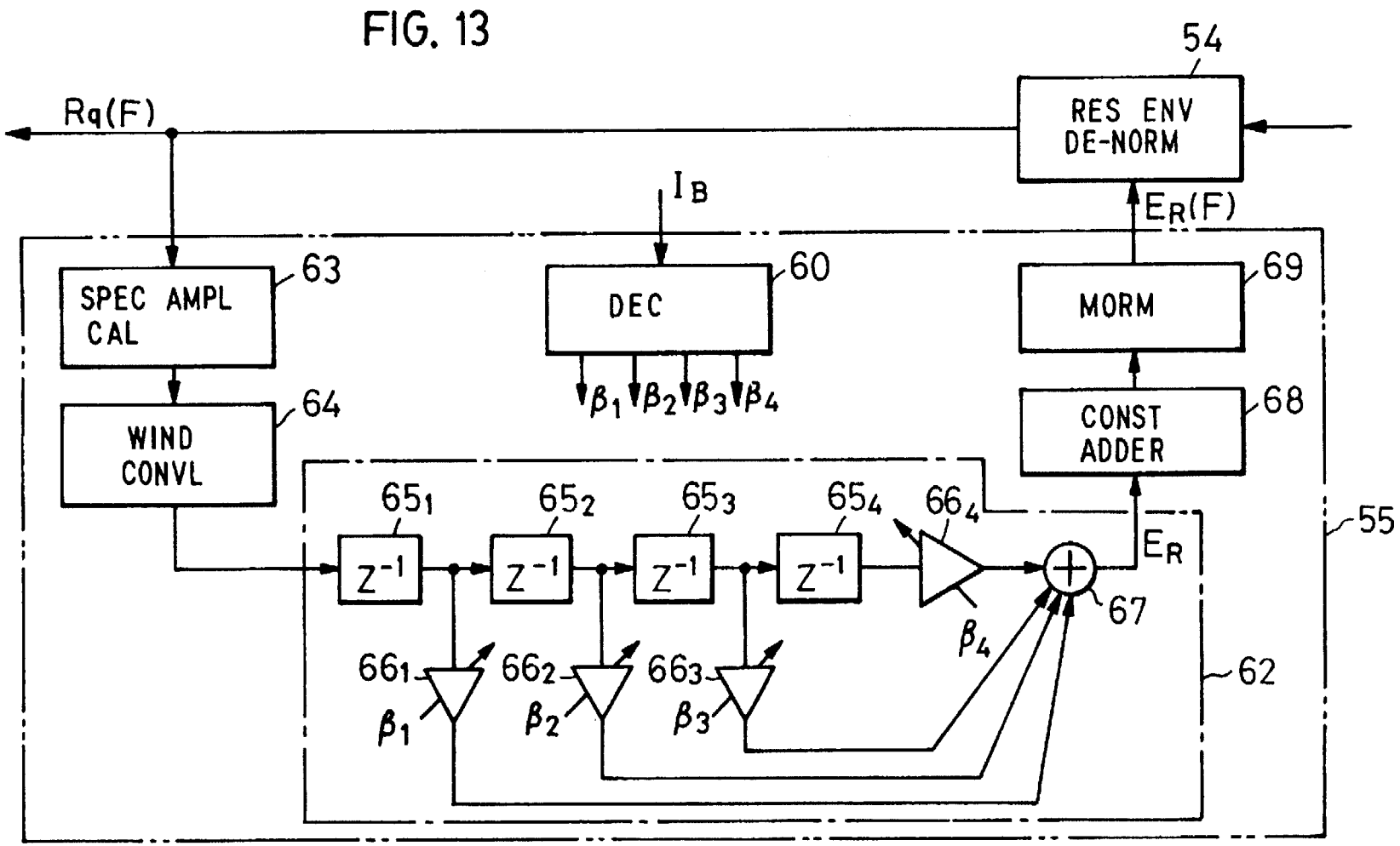
FIG. 13 is a block diagram illustrating an example of a residual-coefficients envelope calculation part 55 in the decoder side which corresponds to the residual-coefficients envelope calculation part 23 depicted in FIG. 12.

That is, as shown in FIG. 13 which is a block diagram of the residual-coefficients envelope calculation part 55 of the decoder 50, the quantization indexes $I_B$ of the prediction coefficients $\beta_1$ to $\beta_4$ of the current frame, fed from the prediction coefficient calculation part 40 of the coder 10, are decoded in a decoding part 60 to obtain decoded prediction coefficients $\beta_1$ to $\beta_4$, which are set in multipliers $\mathbf{66}_1$ to $\mathbf{66}_4$ of a linear combination part 62. These prediction coefficients $\beta_1$ to $\beta_4$ are multiplied by the outputs from delay stages $\mathbf{65}_1$ to $\mathbf{65}_4$, respectively, and the multiplied outputs are added by an adder 67 to synthesize the residual-coefficient envelope $E_R$. As in the case of the coder 10, the thus synthesized residual-coefficients envelope $E_R$ is processed in a constant addition part 68 and a normalization part 69, thereafter being provided as the residual-coefficients envelope $E_R(F)$ of the current frame to the de-normalization part 54. In the residual-coefficients envelope de-normalization part 54 the fine structure coefficients of the current frame from the power de-normalization part 53 are multiplied by the above-said residual-coefficients envelope $E_R(F)$ to obtain the reproduced residual coefficients $R_q(F)$ of the current frame, which are provided to a spectrum amplitude calculation part 63 and the de-normalization part 57 (FIG. 3). In the spectrum amplitude calculation part 63 and a window function convolution part 64 the reproduced residual coefficients $R_q(F)$ are subjected to the same processing as in the corresponding parts of the coder 10, by which the spectrum envelope of the residual coefficients is generated, and the spectrum envelope is fed to the linear combination part 62. Accordingly, the residual-coefficients envelope calculation part 55 of the decoder 50, corresponding to the residual-coefficients envelope calculation part 23 shown in FIG. 12, has no prediction coefficient calculation part. The quantization of the prediction coefficients in the prediction coefficient calculation part 40 in FIG. 12 can be achieved, for example, by an LSP quantization method which transforms the prediction coefficients to LSP parameters and then subjecting them to quantization processing such as inter-frame difference vector quantization.

In the residual-coefficients envelope calculation parts 23 shown in FIGS. 8–10 and 12, the multiplication coefficients $\beta_1$ to $\beta_4$ of the multipliers $\mathbf{36}_1$ to $\mathbf{36}_4$ may be prefixed according to the degree of contribution of the residual-coefficient spectrum envelopes $E_1$ to $E_4$ of one to four preceding frames to the composite residual-coefficients envelope $E_R$ which is the output of the current frame from the adder 34; for example, the older the frame, the smaller the weight (multiplication coefficient). Alternatively, the same weight ¼, in this example, may be used and an average value of samples of four frames may also be used. When the coefficients $\beta_1$ to $\beta_4$ are fixed in this way, the prediction coefficient calculation part 40 is unnecessary which conducts the calculations of Eqs. (4) and (5). In this case, the residual-coefficients envelope calculation part 55 of the decoder 50 may also use the same coefficients $\beta_1$ to $\beta_4$ as those in the coder 10, and consequently, there is no need of transferring the coefficients $\beta_1$ to $\beta_4$ to the decoder 50. Also in the example of FIG. 11, the coefficients $\beta_1$ to $\beta_4$ may be fixed.

The configurations of the residual-coefficients envelope calculation parts 23 shown in FIGS. 8–10 and 12 can be simplified; for example, in FIG. 8, the adder 34, the delay stages $\mathbf{35}_2$ to $\mathbf{35}_4$ and the multipliers $\mathbf{36}_2$ to $\mathbf{36}_4$ are omitted, the output from the multiplier $\mathbf{36}_1$ is applied directly to the constant addition part 38, and the residual-coefficients envelope $E_R(F)$ is estimated from the spectrum envelope $E_1$=E (F−1) of the preceding frame F−1 alone. This modification is applicable to the example of FIG. 10, in which case only the outputs from the multipliers $\mathbf{36}_1$, $\mathbf{8}_{p1}$ and $\mathbf{8}_{n1}$ are supplied to the adder 34.

In the examples of FIGS. 3 and 8–12, the residual-coefficients envelope calculation part 23 calculates the predicted residual-coefficient envelope $E_R(F)$ by determining the prediction coefficients $\beta$ ($\beta_1$, $\beta_2$, . . . ) through linear prediction so that the composite residual-coefficient envelope $E_R$" comes as close to the spectrum envelope E(F) as possible which is calculated on the basis of the input reproduced residual coefficients $R_q(F)$ or residual coefficients R(F). A description will be given, with reference to FIGS. 14, 15 and 16, of embodiments which determine the residual-coefficients envelope without involving such linear prediction processing.

Figure 14:
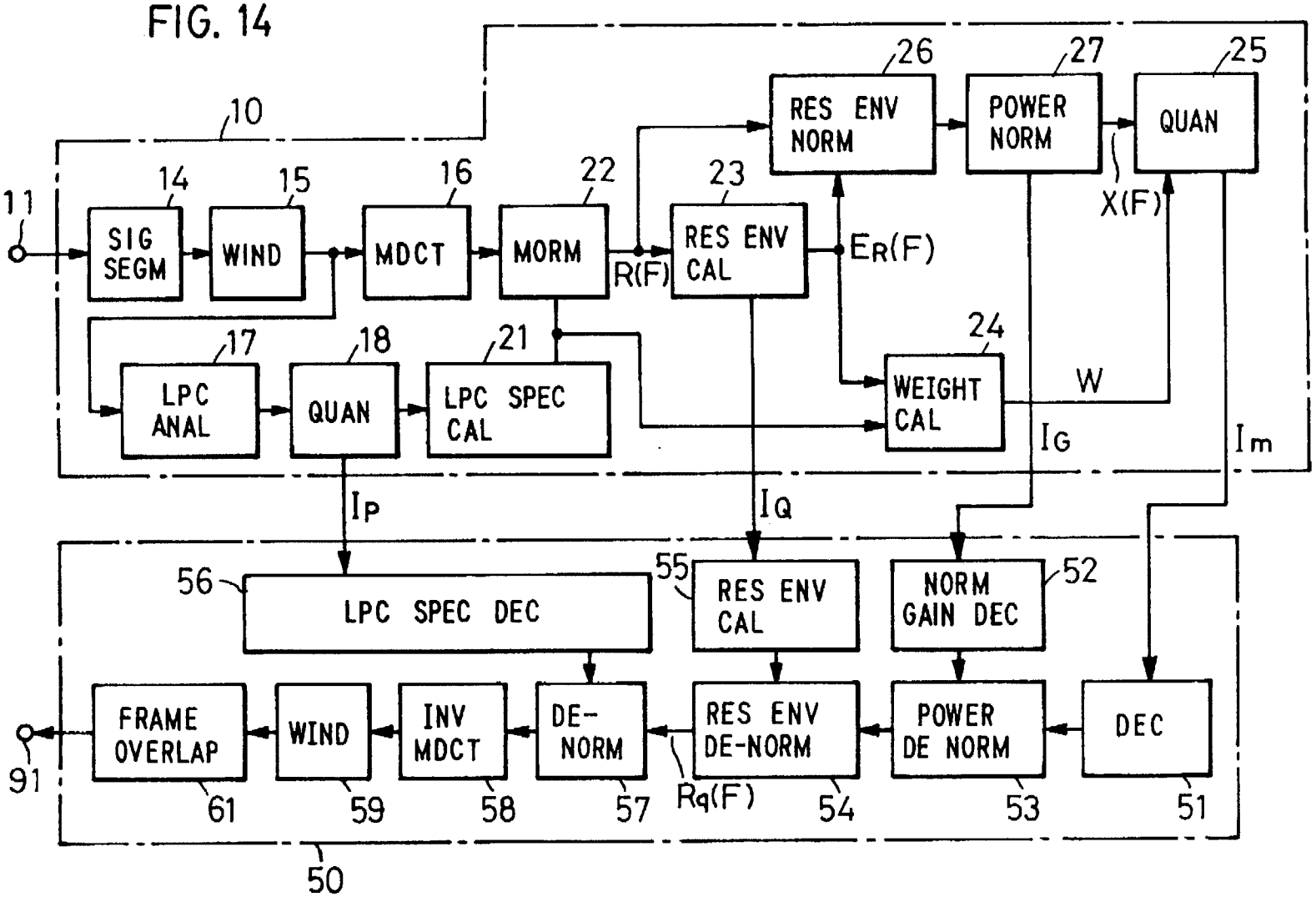
FIG. 14 is a block diagram illustrating other embodiments of the coder and decoder according to the present invention.

FIG. 14 is a block diagram corresponding to FIG. 3, which shows the entire constructions of the coder 10 and the decoder 50, and the connections to the residual-coefficients envelope calculation part 23 correspond to the connection indicated by the broken line in FIG. 3. Accordingly, there is not provided the same de-normalization part 31 as in the FIG. 12 embodiment. Unlike in FIGS. 3 and 12, the residual-coefficients envelope calculation part 23 quantizes the spectrum envelope of the input residual coefficients R(F) so that the residual-coefficients envelope $E_R$ to be obtained by linear combination approaches the spectrum envelope as much as possible; the linearly combined output $E_R$ is used as the residual-coefficients envelope $E_R(F)$ and the quantization index $I_Q$ at that time is fed to the decoder 50. The decoder 50 decodes the input spectrum envelope quantization index $I_Q$ in the residual-coefficients envelope calculation part 55 to reproduce the spectrum envelope E(F), which is provided to the de-normalization part 54. The processing in each of the other parts is the same as in FIG. 3, and hence will not be described again.

Figure 15:
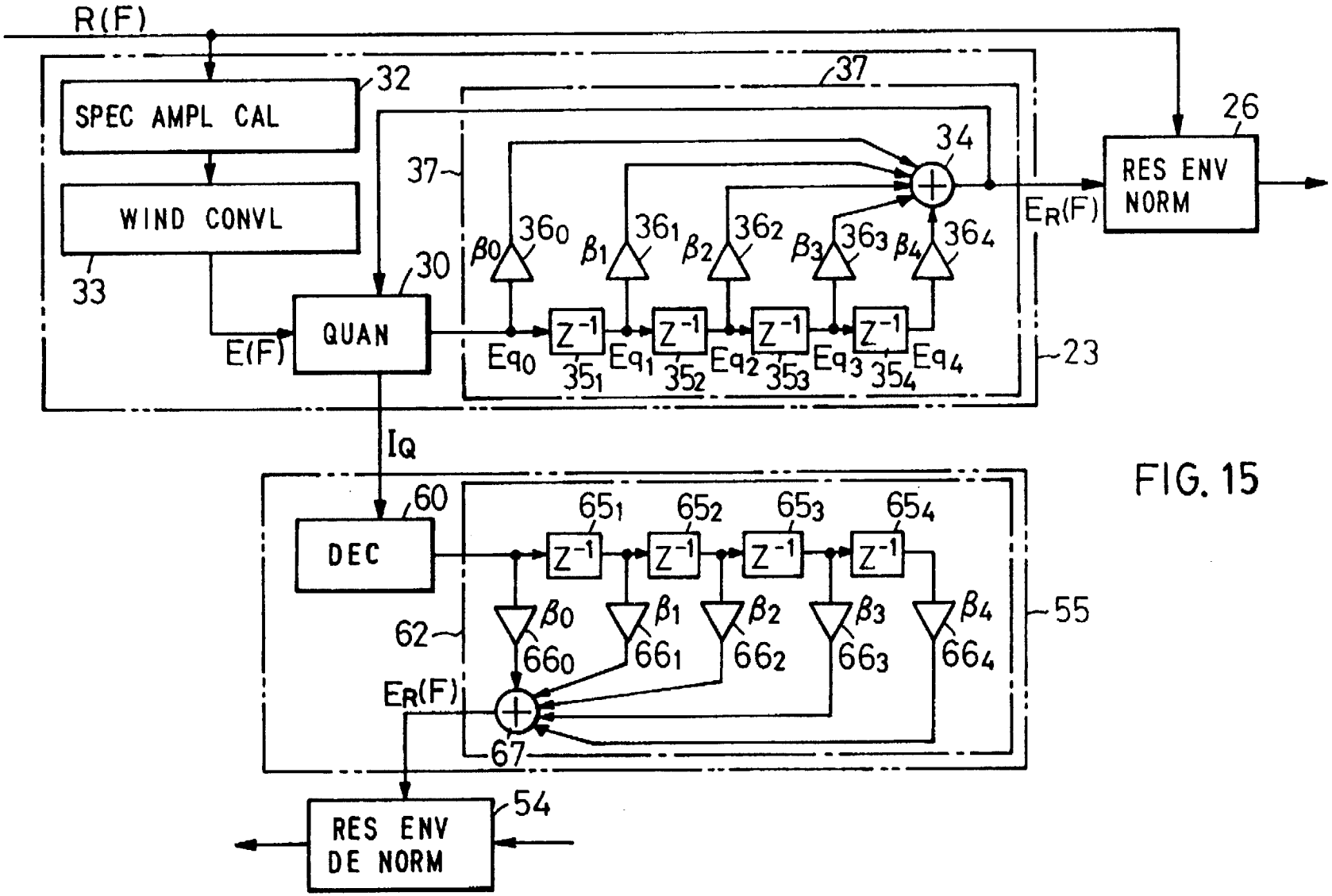
FIG. 15 is a block diagram illustrating specific operative examples of residual-coefficients envelope calculation parts 23 and 55 in FIG. 14.

FIG. 15 illustrates examples of the residual-coefficients envelope calculation parts 23 and 55 of the coder 10 and the decoder 50 in the FIG. 14 embodiment. The residual-coefficients envelope calculation part 23 comprises: the spectrum amplitude calculation part 32 which is supplied with the residual coefficients R(F) and calculates the spectrum amplitudes at the N sample points; the window function convolution part 33 which convolutes the window function into the N-point spectrum amplitudes to obtain the spectrum envelope E(F); the quantization part 30 which quantizes the spectrum envelope E(F); and the linear combination part 37 which is supplied with the quantized spectrum envelope as quantized spectrum envelope coefficients $E_{q0}$ for linear combination with quantized spectrum envelope coefficients of preceding frames. The linear combination part 37 has about the same construction as in the FIG. 12 example; it is made up of the delay stages $\mathbf{35}_1$ to $\mathbf{35}_4$, the multipliers $\mathbf{36}_1$ to $\mathbf{36}_4$ and the adder 34. In this embodiment, the result of a multiplication of the input quantized spectrum envelope coefficients $E_{q0}$ of the current frame by a prediction coefficient $\beta_0$ in a multiplier $\mathbf{36}_0$ as well as the results of multiplications of quantized spectrum envelope coefficients $E_{q1}$ to $E_{q4}$ of first to fourth previous frames by prediction coefficients $\beta_1$ to $\beta_4$ are combined by the adder 34, from which the added output is provided as the predicted residual-coefficients envelope $E_R(F)$. The prediction coefficients $\beta_0$ to $\beta_4$ are predetermined values. The quantization part 30 quantizes the spectrum envelope E(F) so that the square error of the residual-coefficients envelope $E_R(F)$ from the input spectrum envelope E(F) becomes minimum. The quantized spectrum envelope coefficients $E_{q0}$ thus obtained is provided to the linear combination part 37 and the quantization index $I_Q$ is fed to the residual-coefficients envelope calculation part 55 of the decoder.

The decoding part 60 of the residual-coefficients envelope calculation part 55 decodes the quantized spectrum envelope coefficients of the current frame from the input quantization index $I_Q$. The linear combination part 62, which is composed of the delay stages $65_1$ to $65_4$, the multipliers $66_0$ to $66_4$ and the adder 67 as is the case with the coder 10 side, linearly combines the quantized spectrum envelope coefficients of the current frame from the decoding part 60 and quantized spectrum envelope coefficients of previous frames from the delay stages $65_1$ to $65_4$. The adder 67 outputs the thus combined residual-coefficients envelope $E_R(F)$, which is fed to the de-normalization part 54. In the multipliers $66_0$ to $66_4$ there are set the same coefficients $\beta_0$ to $\beta_4$ as those on the coder 10 side. The quantization in the quantization part of the coder 10 may be a scalar quantization or a vector one as well. In the latter case, it is possible to employ the vector quantization of the interleaved coefficient sequence as described previously with respect to FIG. 7.

Figure 16:
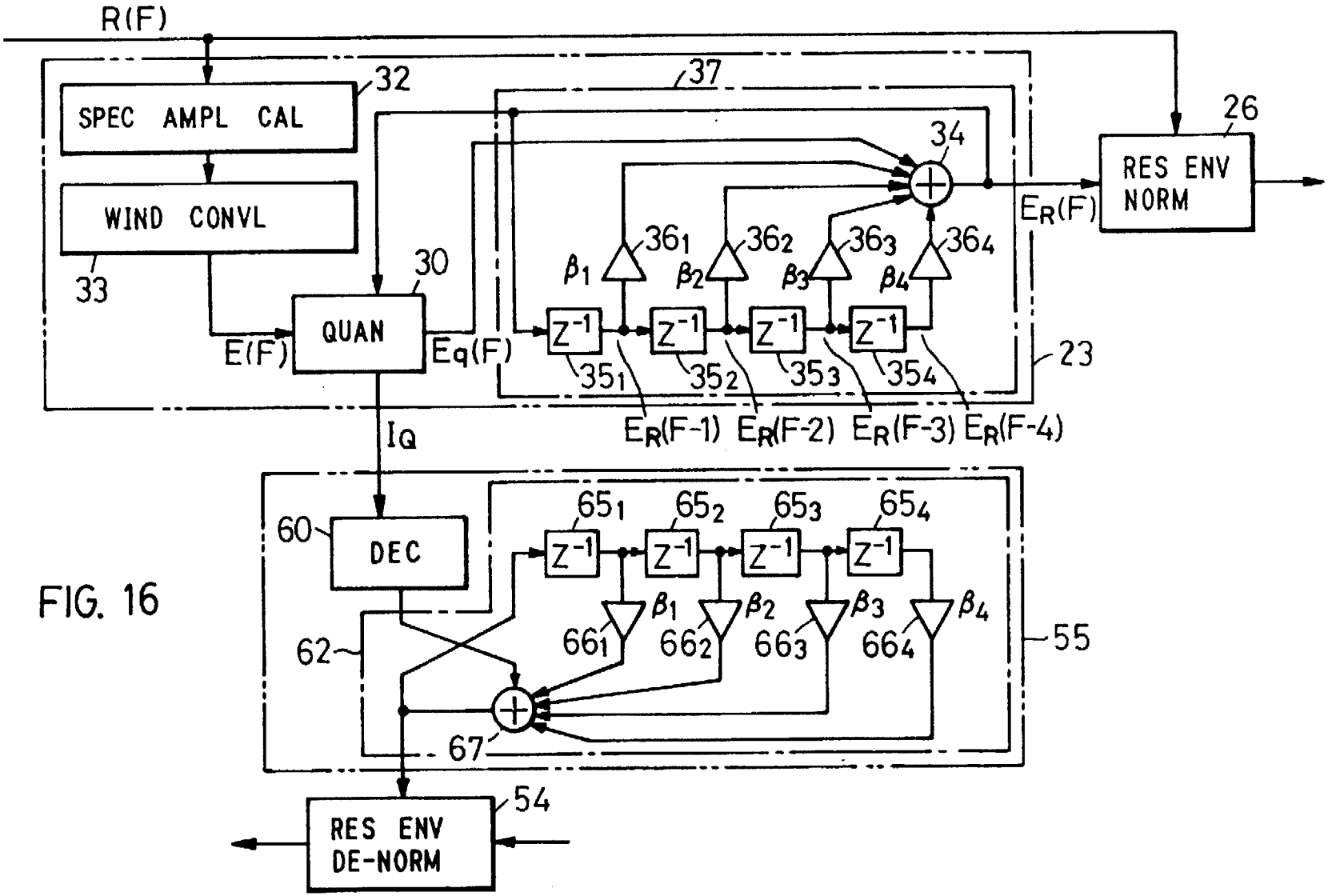
FIG. 16 is a block diagram illustrating other specific operative examples of the residual-coefficients envelope calculation parts 23 and 55 in FIG. 14.

FIG. 16 illustrates a modified form of the FIG. 15 embodiment, in which the parts corresponding to those in the latter are identified by the same reference numerals. This embodiment is common to the FIG. 15 embodiment in that the quantization part 30 quantizes the spectrum envelope E(F) so that the square error of the predicted residual-coefficients envelope (the output from the adder 34) $E_R(F)$ from the spectrum envelope E(F) becomes minimum, but differs in the construction of the linear combination part 37. That is, the predicted residual-coefficients envelope $E_R(F)$ is input into the cascade-connected delay stages $35_1$ through $35_4$, which output predicted residual-coefficients envelopes $E_R(F-1)$ through $E_R(F-4)$ of first through fourth preceding frames, respectively. Furthermore, the quantized spectrum envelope $E_q(F)$ from the quantization part 30 is provided directly to the adder 34. Thus, the linear combination part 37 linearly combines the predicted residual-coefficients envelopes $E_R(F-1)$ through $E_R(F-4)$ of the first through fourth preceding frames and the quantized envelope coefficients of the current frame F and outputs the predicted residual-coefficients envelope $E_R(F)$ of the current frame. The linear combination part 62 of the decoder 50 side is similarly constructed, which regenerates the residual-coefficients envelope of the current frame by linearly combining the composite residual-coefficients envelopes of the preceding frames and the reproduced quantized envelope coefficients of the current frame.

Figure 17:
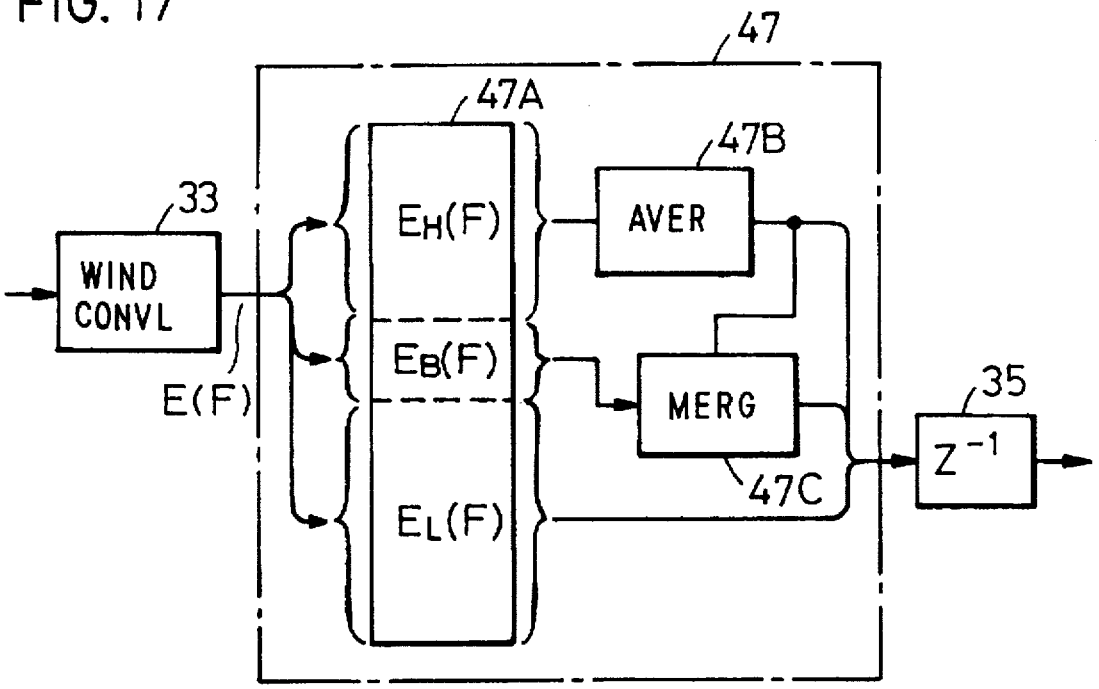
FIG. 17 is a block diagram illustrating the construction of a band processing part which approximates a high-order band component of a spectrum envelope to a fixed value in the residual-coefficients envelope calculation part 23.

In each of the residual-coefficients envelope calculation part 23 of the examples of FIGS. 8–12, 15 and 16, it is also possible to provide a band processing part, in which each spectrum envelope from the window function convolution part 33 is divided into a plurality of bands and a spectrum envelope section for a higher-order band with no appreciable fluctuations is approximated to a flat envelope of a constant amplitude. FIG. 17 illustrates an example of such a band processing part 47 which is interposed between the convolution part 33 and the delay part 35 in FIG. 8, for instance. In this example, the output E(F) from the window function convolution part 33 is input into the band processing part 47, wherein it is divided by a dividing part 47A into, for example, a narrow intermediate band of approximately 50-order components $E_B(F)$ centering about a sample point about ⅔ of the entire band up from the lowest order (the lowest frequency), a band of higher-order components $E_H(F)$ and a band of lower-order components $E_L(F)$. The higher-order band components $E_H(F)$ are supplied to an averaging part 47B, wherein their spectrum amplitudes are average and the higher-order band components $E_H(F)$ are all replaced with the average value, whereas the lower-order band components $E_L(F)$ are outputted intact. The intermediate band components $E_B(F)$ are fed to a merging part 47C, wherein the spectrum amplitudes are subjected to linear variation so that the spectrum amplitudes at the highest and lowest ends of the intermediate band merge into the average value calculated in the averaging part 47B and the highest-order spectrum amplitude of the lower-order band, respectively. That is, since the high-frequency components do not appreciably vary, the spectrum amplitudes in the higher-order band are approximated to a fixed value, an average value in this example.

In the residual-coefficients envelope calculation part 23 in the examples of FIGS. 8–12, plural sets of preferable prediction coefficients $\beta_1$ to $\beta_Q$ (or $\beta_u$) corresponding to a plurality of typical states of an input acoustic signal may be prepared in a codebook as coefficient vectors corresponding to indexes. In accordance with every particular state of the input acoustic signal, the coefficients are selectively read out of the codebook so that the best prediction of the residual-coefficients envelope can be made, and the index indicating the coefficient vector is transferred to the residual-coefficients envelope calculation part 55 of the decoder 50.

In the linear prediction model which predicts the residual-coefficients envelope of the current frame from those of the previous frames as in the embodiments of FIGS. 8–11, a parameter k is used to check the safety of the system. Also in the present invention, provision can be made for providing increased safety of the system. For example, each prediction coefficient is transformed to the k parameter, and when its absolute value is close to or greater than 1.0, the parameter is forcibly set to a predetermined coefficient, or the residual-coefficients envelope generating scheme is changed from the one in FIG. 8 to the one in FIG. 9, or the residual-coefficients envelope is changed to a predetermined one (a flat signal without roughness, for instance).

Figure 18:
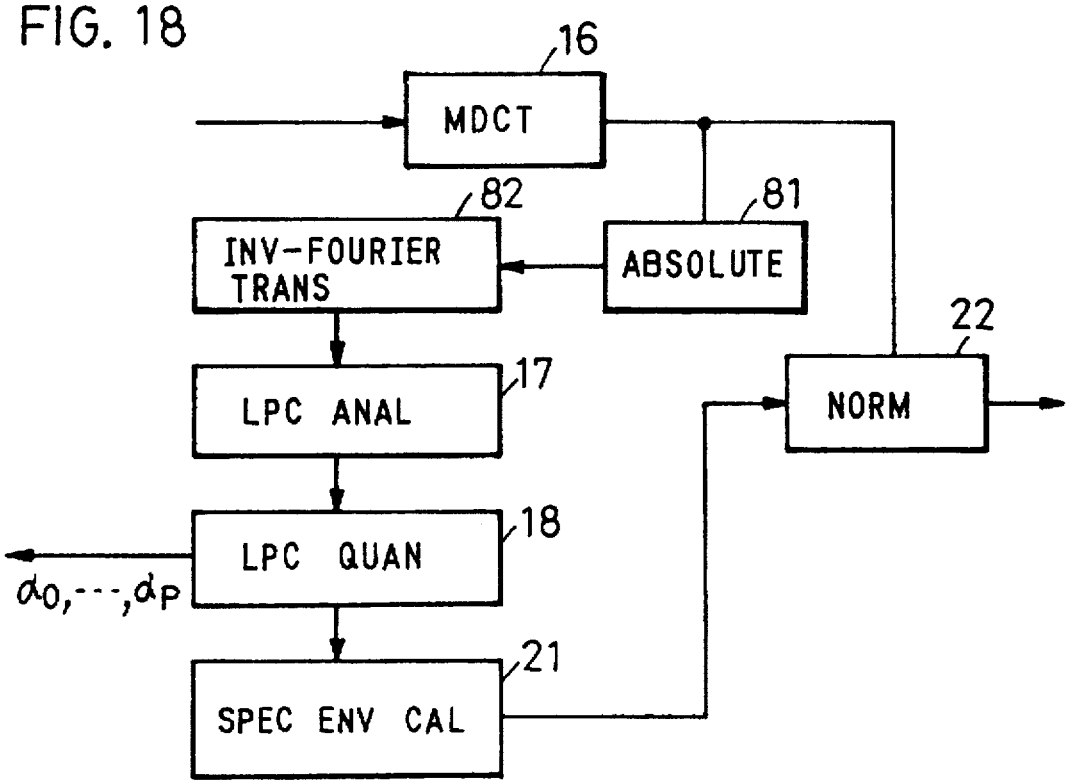
FIG. 18 is a block diagram showing a partly modified form of the coder depicted in FIG. 3.

In the embodiments of FIGS. 3 and 14, the coder 10 calculates the prediction coefficients through utilization of the auto-correlation coefficients of the input acoustic signal from the windowing part 15 when making the linear predictive coding analysis in the LPC analysis part 17. Yet it is also possible to employ such a construction as shown in FIG. 18. An absolute value of each sample (spectrum) of the frequency-domain coefficients obtained in the MDCT part 16 is calculated in an absolute value calculation part 81, then the absolute value output is provided to an inverse Fourier transform part 82, wherein it is subjected to inverse Fourier transform processing to obtain auto-correlation functions, which are subjected to the linear predictive coding analysis in the LPC analysis part 17. In this instance, there is no need of calculating the correlation prior to the analysis.

Figure 19:
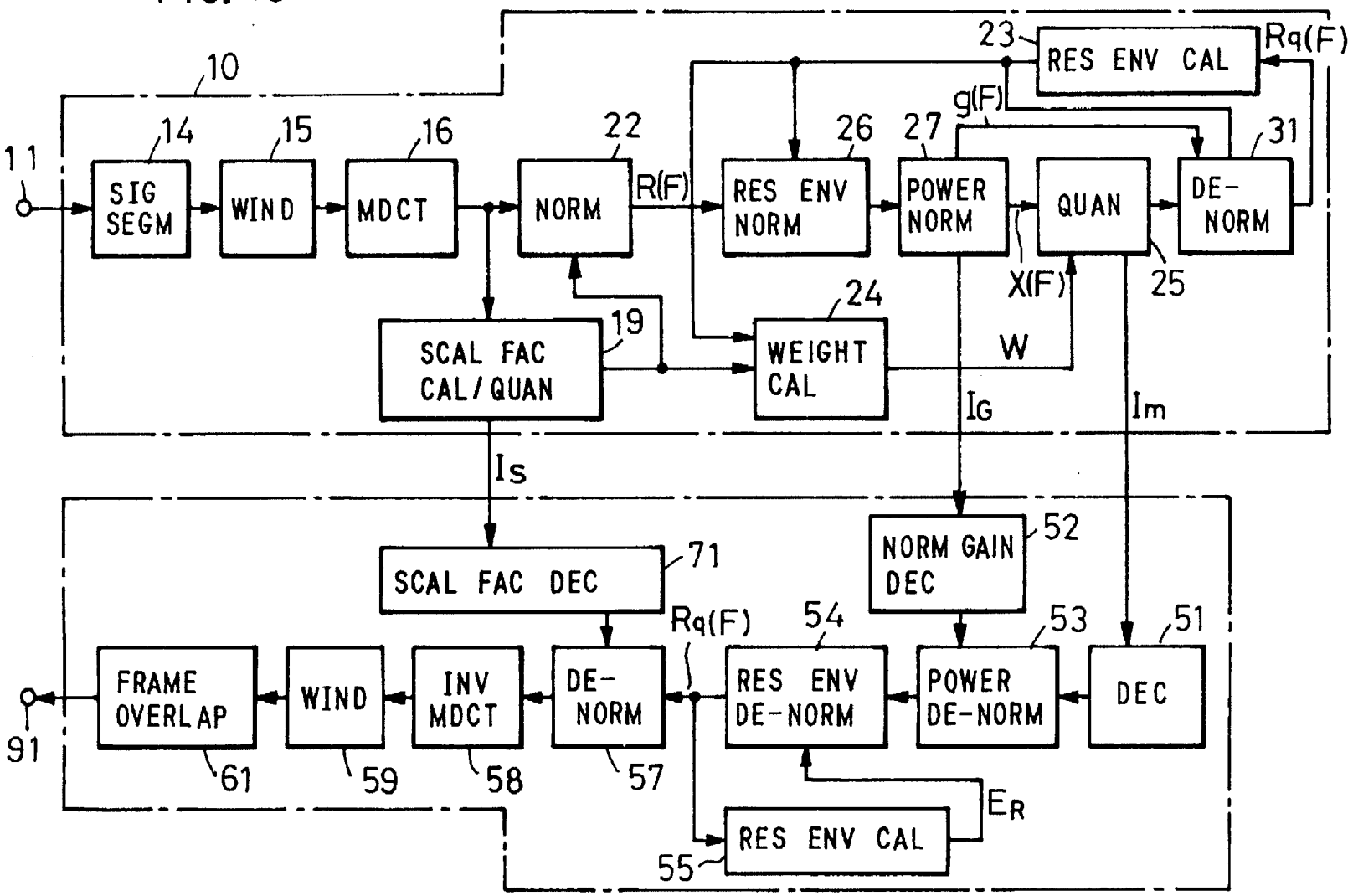
FIG. 19 is a block diagram illustrating other examples of the coder and the decoder embodying the coding method and the decoding method of the present invention.

In the embodiments of FIGS. 3 and 14, the coder 10 quantizes the linear prediction coefficients $\alpha_0$ to $\beta_p$ of the input signal, then subjects the quantized prediction coefficients to Fourier transform processing to obtain the spectrum envelope (the envelope of the frequency characteristics) of the input signal and normalizes the frequency characteristics of the input signal by its envelope to obtain the residual coefficients. The index $I_p$ of the quantized prediction coefficients is transferred to the decoder, wherein the linear prediction coefficients $\alpha_0$ to $\beta_p$ are decoded from the index $I_p$ and are used to obtain the envelope of the frequency characteristics. Yet it is also possible to utilize such a construction as shown in FIG. 19, in which the parts corresponding to those in FIG. 3 are identified by the same reference numerals. The frequency-domain coefficients from the MDCT part 16 are also supplied to a scaling factor calculation/quantization part 19, wherein the frequency-domain coefficients are divided into a plurality of subbands, then an average or maximum one of absolute samples values for each subband is calculated as a scaling factor, which is quantized, and its index $I_S$ is sent to the decoder 50. In the normalization part 22 the frequency-domain coefficients from the MDCT part are divided by the scaling factors for the respective corresponding subbands to obtain the residual coefficients R(F), which are provided to the normalization part 22. Furthermore, in the weighting factor calculation part 24, the scaling factors and the samples in the corresponding subbands of the residual-coefficients envelope from the residual-coefficients envelope calculation part 23 are multiplied by each other to obtain weighting factors W ($w_1, \ldots, w_N$), which are provided to the quantization part 25. In the decoder 50, the scaling factors are decoded from the inputted index $I_S$ in a scaling factor decoding part 71 and in the de-normalization part 57 the reproduced residual coefficients are multiplied by the decoded scaling factors to reproduce the frequency-domain coefficients, which are provided to the inverse MDCT part 58.

Figure 20:
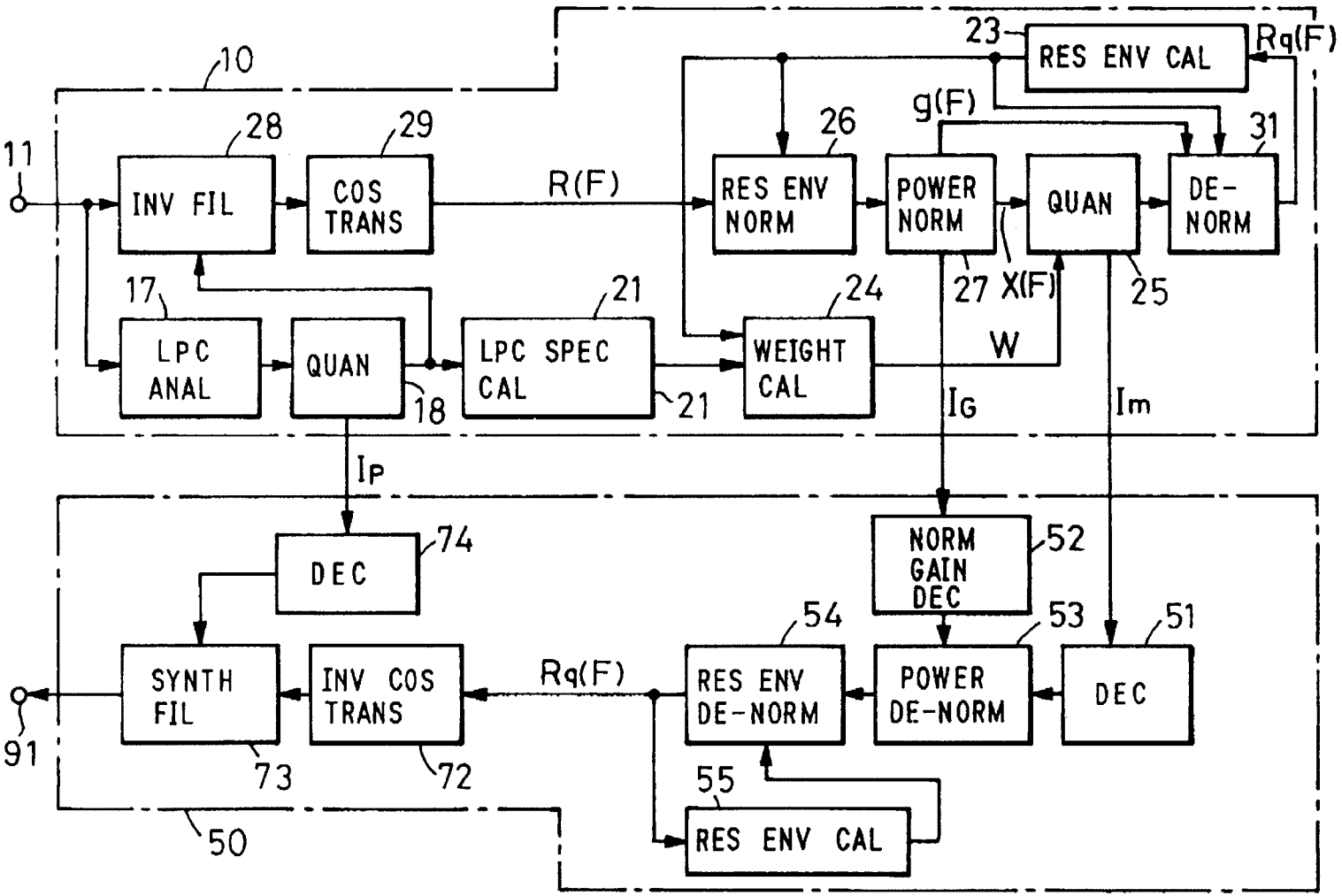
FIG. 20 is a block diagram illustrating examples of a coder of the type that obtains a residual signal in the time domain and a decoder corresponding thereto.

While in the above the residual coefficients are obtained after the transformation of the input acoustic signal to the frequency-domain coefficients, it is also possible to obtain from the input acoustic signal a residual signal having its spectrum envelope flattened in the time domain and transform the residual signal to residual coefficients in the frequency domain. As illustrated in FIG. 20 wherein the parts corresponding to those in FIG. 3 are identified by the same reference numerals, the input acoustic signal from the input terminal 11 is subjected to the linear prediction coding analysis in the LPC analysis part 17, then the resulting linear prediction coefficients $\beta_0$ to $\beta_p$ are quantized in the quantization part 18 and the quantized linear prediction coefficients are set in an inverse filter 28. The input acoustic signal is applied to the inverse filter 28, which yields a time-domain residual signal of flattened frequency characteristics. The residual signal is applied to a DCT part 29, wherein it is transformed by discrete cosine transform processing to the frequency-domain residual coefficients R(F), which are fed to the normalization part 26. On the other hand, the quantized linear prediction coefficients are provided from the quantization part 18 to a spectrum envelope calculation part 21, which calculates and provides the envelope of the frequency characteristics of the input signal to the weighting factor calculation part 24. The other processing in the coder 10 is the same as in the FIG. 3 embodiment.

In the decoder 50, the reproduced residual coefficients $R_q(F)$ from the de-normalization part 54 are provided to an inverse cosine transform part 72, wherein they are transformed by inverse discrete cosine transform processing to a time-domain residual signal, which is applied to a synthesis filter 73. On the other hand, the index $I_p$ inputted from the coder 10 is fed to a decoding part 74, wherein it is decoded to the linear prediction coefficients $\alpha_0$ to $\alpha_p$, which are set as filter coefficients of the synthesis filter 73. The residual signal is applied from the inverse cosine transform part 72 to the synthesis filter 73, which synthesizes and provides an acoustic signal to the output terminal 91. In the FIG. 20 embodiment it is preferable to use the DCT scheme rather than the MDCT one for the time-to-frequency transformation.

Figure 21:
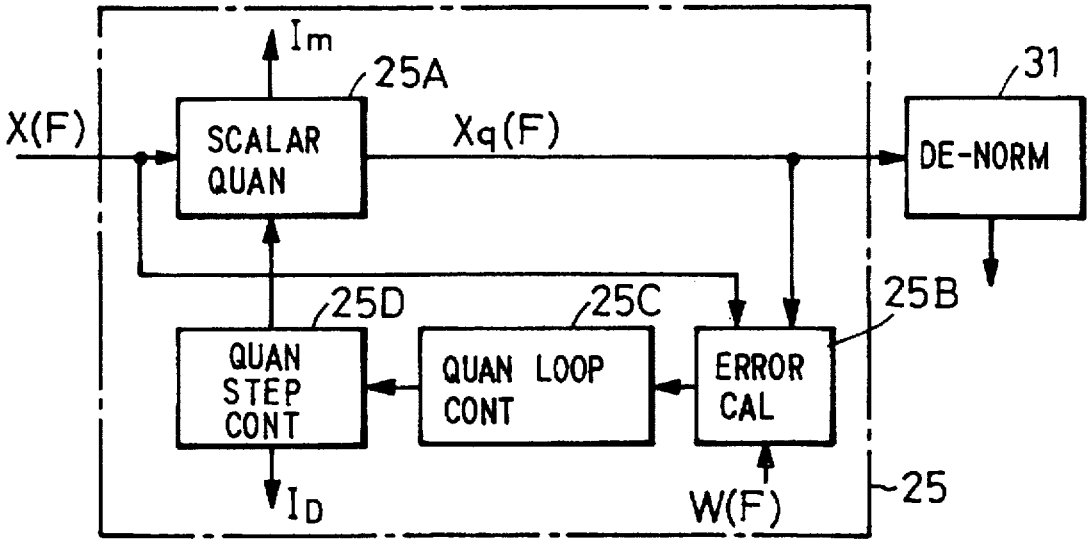
FIG. 21 is a block diagram illustrating another example of the construction of the quantization part 25 in the embodiments of FIGS. 3, 14, 19 and 20.
Figure 22:
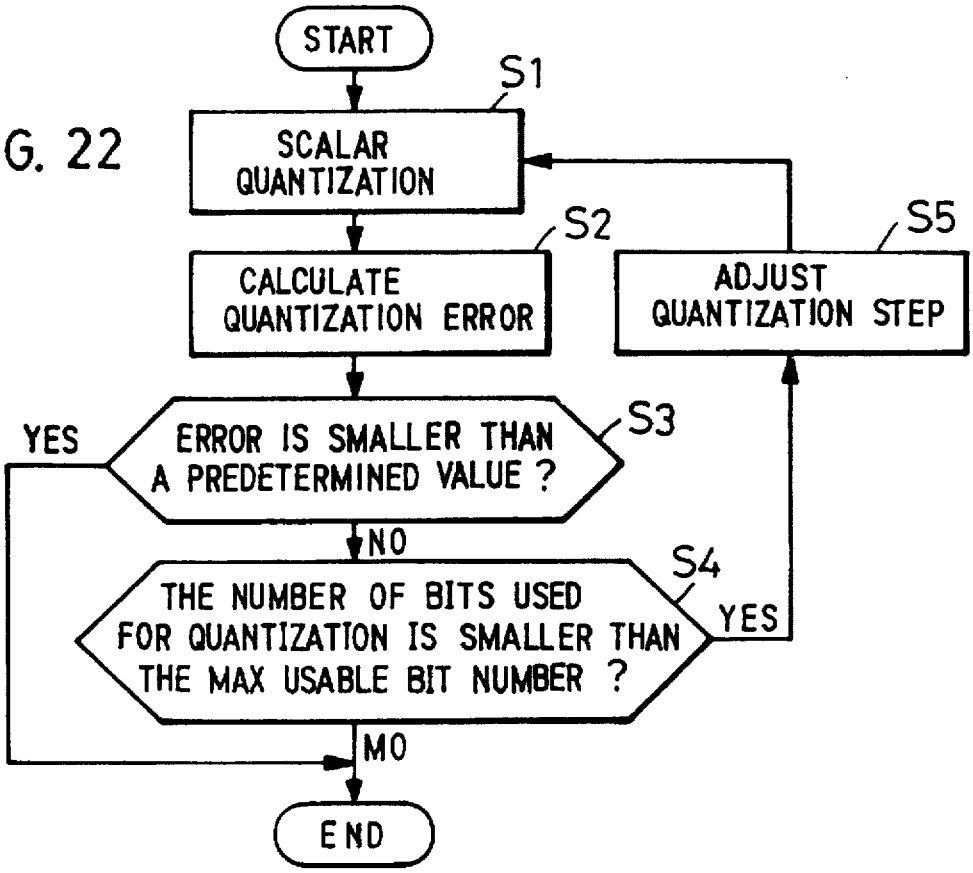
FIG. 22 is a flowchart showing the procedure for quantization in the quantization part depicted in FIG. 21.

In the embodiments of FIGS. 3, 14, 19 and 20, the quantization part 25 may be constructed as shown in FIG. 21, in which case the quantization is performed following the procedure shown in FIG. 22. At first, in a scalar quantization part 25A, the normalized fine structure coefficients X(F) from the power normalization part 27 (see FIG. 3 for example) are scalar-quantized with a predetermined maximum quantization step which is provided from a quantization step control part 25D (S1 in FIG. 22). Next, an error of the quantized fine structure coefficients $X_q(F)$ from the input one X(F) is calculated in an error calculation part 25B (S2). The error that is used in this case is, for example, a weighted square error utilizing the weighting factors W. In a quantization loop control part 25C a check is made to see if the quantization error is smaller than a predetermined value that is psycho-acoustically permissible (S3). If the quantization error is smaller than the predetermined value, the quantized fine structure coefficients $X_q(F)$ and an index $I_m$ representing it are outputted and an index $I_D$ representing the quantization step used is outputted from the quantization step control part 25D, with which the quantization processing terminates. When it is judged in step S3 that the quantization error is larger than the predetermined value, the quantization loop control part 25C makes a check to see if the number of bits used for the quantized fine structure coefficients $X_q(F)$ is in excess of the maximum allowable number of bits (S4). If not, the quantization loop control part 25C judges that the processing loop be maintained, and causes the quantization step control part 25D to furnish the scalar quantization part 25A with a predetermined quantization step smaller than the previous one (S5); then, the scalar quantization part 25A quantizes again the normalized fine structure coefficients X(F). Thereafter, the same procedure is repeated. When the number of bits used is larger than the maximum allowable number in step S4, the quantized fine structure coefficients $X_q(F)$ and its index $I_m$ by the previous loop are outputted together with the quantization step index $I_D$, with which the quantization processing terminates.

To the decoding part 51 of the decoder 50 corresponding to the quantization part 25 (see FIGS. 3, 14, 19 and 20), the quantization index $I_m$ and the quantization step index $I_D$ are provided, on the basis of which the decoding part 51 decodes the normalized fine structure coefficients.

As described above, according to the present invention, a high inter-frame correlation in the frequency-domain residual coefficients, which appear in an input signal containing pitch components, is used to normalize the envelope of the residual coefficients to obtain fine structure coefficients of a flattened envelope, which are quantized; hence, high quantization efficiency can be achieved. Even if a plurality of pitch components are contained, no problem will occur because they are separated in the frequency domain. Furthermore, the envelope of the residual coefficients is adaptively determined, and hence is variable with the tendency of change of the pitch components.

In the embodiment in which the input acoustic signal is transformed to the frequency-domain coefficients through utilization of the lapped orthogonal transform scheme such as MDST and the frequency-domain coefficients are normalized, in the frequency domain, by the spectrum envelope obtained from the linear prediction coefficients of the acoustic signal (i.e. the envelope of the frequency characteristics of the input acoustic signal), it is possible to implement high efficiency flattening of the frequency-domain coefficients without generating inter-frame noise.

In the case of coding and decoding various music sources through use of the residual-coefficients envelope calculation part 23 in FIG. 8 under the conditions that P=60, N=512, M=64 and Q=2, that the amount of information for quantizing the linear prediction coefficients $\alpha_0$ to $\alpha_p$ and the normalization gain is set to a large value and that the fine structure coefficients are vector-quantized with an amount of information of 2 bits/sample, the segmental SN ratio is improved about 5 dB on an average and about 10 dB at the maximum as compared with that in the case of coding and decoding the music sources without using the residual-coefficients envelope calculation parts 23 and 55. Besides, it is possible to produce more natural high-pitch sounds psycho-acoustically.

It will be apparent that many modifications and variations may be effected without departing from the scope of the novel concepts of the present invention.

What is claimed is:

1. An acoustic signal transform coding method which transforms an input acoustic signal to frequency-domain coefficients and encodes them to produce coded output, said method comprising the steps of:

(a) obtaining residual coefficients having a flattened envelope of the frequency characteristics of said input acoustic signal on a frame-by-frame basis;

(b) predicting the envelope of said residual coefficients of the current frame on the basis of said residual coefficients of the current or previous frame to produce a predicted residual-coefficients envelope;

(c) normalizing said residual coefficients of the current frame by said predicted residual-coefficients envelope to produce fine structure coefficients; and (d) quantizing said fine structure coefficients and outputting index information representative of said quantized fine structure coefficients as part of said coded output.

2. The coding method of claim 1, wherein said step (b) includes the steps of:

(e) de-normalizing said quantized fine structure coefficients by said predicted residual-coefficients envelope of the current frame to generate reproduced residual coefficients;

(f) processing said reproduced residual coefficients to produce their spectrum envelope; and (g) synthesizing said predicted residual-coefficients envelope for residual coefficients of the next frame on the basis of said spectrum envelope.

3. The coding method of claim 2, wherein said step (g) includes synthesizing said predicted residual-coefficients envelope by linear combination of the spectrum envelopes of said reproduced residual coefficients of a predetermined one or more contiguous frames preceding the current frame.

4. The coding method of claim 3, wherein said step (b) includes a step (h) of controlling said linear combination of said spectrum envelopes of said previous frames so that said predicted residual-coefficients envelope, which is synthesized on the basis of the spectrum envelopes of said reproduced residual coefficients of said previous frames, approaches the envelope of said residual coefficients of the current frame as a target.

5. The coding method of claim 4, wherein optimum control of said linear combination is determined aiming at the spectrum envelope of said reproduced residual coefficients of the current frame as said target and the thus determined optimum control is applied to said linear combination in the next frame.

6. The coding method of claim 4, wherein optimum control of said linear combination is determined aiming at the spectrum envelope of said residual coefficients of the current frame as said target and the thus determined optimum control is applied to the linear combination of said predicted residual-coefficients envelope in the current control.

7. The coding method of claim 5 or 6, wherein said linear combination in said step (g) is a process of multiplying the spectrum envelopes of said reproduced residual coefficients of said previous frames by prediction coefficients, respectively, and adding the multiplied results to obtain said predicted residual-coefficients envelope, and said step (h) includes a process of determining said prediction coefficients so that said added result approaches said target.

8. The coding method of claim 7, wherein said step (h) includes a step (i) of outputting, as another part of said coded output, index information representing quantization of said prediction coefficients when said target for determining said prediction coefficients is the spectrum envelope of said residual coefficients of the current frame.

9. The coding method of claim 7, wherein said linear combination in said step (g) includes generating a first sample group and a second sample group displaced at least one sample on the frequency axis from a sample group of each of said previous frames in the positive and the negative direction, respectively, multiplying said first and second sample groups by prediction coefficients and adding all the multiplied results together with the prediction coefficients-multiplied results for said previous frames to obtain said predicted residual-coefficients envelope.

10. The coding method of claim 3, wherein said step (f) includes: a step (j) of calculating, over the current frame and a plurality of previous frames, average values of corresponding samples of said spectrum envelopes obtained from said reproduced residual coefficients, or calculating an average value of the samples in the current frame; and a step (k) of subtracting said average values or said average value from said spectrum envelope of the current frame and providing the subtracted results as said spectrum envelope to said step (g), and wherein said step (g) includes a step (l) of adding said average values or said average value to the result of said linear combination and calculating said predicted residual-coefficients envelope from said added result.

11. The coding method of claim 10, wherein said step (f) includes: a step (m) of calculating the intraframe average amplitude of said subtracted result obtained in said step (k); and a step (n) of dividing said subtracted result in said step (k) by the average amplitude of said subtracted result in said step (m) and providing the divided result as said spectrum envelope to said step (g), and wherein said step (g) includes a step (o) of multiplying the result of said linear combination by the average amplitude of said subtracted result in said step (m) and providing the multiplied result as the result of said linear combination to said step (l).

12. The coding method of claim 3, wherein said step (f) includes convoluting a window function into said spectrum envelope of said reproduced residual coefficients and said step (g) includes performing linear combination by using the convoluted result as said spectrum envelope.

13. The coding method of claim 3, wherein said step (g) includes adding a predetermined constant to the result of said linear combination to obtain said predicted residual-coefficients envelope.

14. The coding method of claim 4, wherein control of said linear combination in said step (h) includes segmenting the target frequency-domain coefficients and the spectrum envelope of said reproduced residual coefficients into pluralities of subbands, respectively, and processing them for each subband.

15. The coding method of claim 1, wherein said step (b) includes quantizing said spectrum envelope of said residual coefficients of the current frame so that said predicted residual-coefficients envelope comes as close to said spectrum envelope as possible, and outputting index information representative of the quantization as another part of said coded output.

16. The coding method of claim 15, wherein said step (b) includes linearly combining said quantized spectrum envelope of the current frame and a quantized spectrum envelope of a past frame through use of predetermined prediction coefficients, determining said quantized spectrums so that the linearly combined envelope comes as close as possible to said spectrum envelope, and obtaining said linear combined envelope at that time as said predicted residual-coefficients envelope.

17. The coding method of claim 15, wherein said step (b) includes linearly combining a quantized spectrum envelope of the current frame and said predicted residual-coefficients envelope of a past frame, determining said quantized spectrum envelope so that the linearly combined envelope comes as close to said spectrum envelope as possible, and obtaining said linearly combined value at that time as said predicted residual-coefficients envelope.

18. The coding method of claim 1, wherein said step (a) includes transforming said input acoustic signal to frequency-domain coefficients, subjecting said input acoustic signal to a linear prediction coding analysis for each frame to obtain linear prediction coefficients, transforming said linear prediction coefficients to frequency-domain coefficients to obtain the spectrum envelope of said input acoustic signal and normalizing said frequency-domain coefficients of said input acoustic signal by said spectrum envelope to obtain said residual coefficients.

19. The coding method of claim 1, wherein said step (a) includes transforming said input acoustic signal to frequency-domain coefficients, inversely transforming the spectrum envelope of said frequency-domain coefficients into a time-domain signal, subjecting said time-domain signal to a linear prediction coding analysis to obtain linear prediction coefficients, transforming said linear prediction coefficients to frequency-domain coefficients to obtain the spectrum envelope of said input acoustic signal and normalizing the frequency-domain coefficients of said input acoustic signal by said spectrum envelope to obtain said residual coefficients.

20. The coding method of claim 18 or 19, wherein a process of transforming said linear prediction coefficients to the frequency-domain coefficients includes quantizing said linear prediction coefficients to obtain quantized linear prediction coefficients, transforming said quantized linear prediction coefficients as said linear prediction coefficients to said frequency-domain coefficients and outputting index information representative of said quantized linear prediction coefficients as another part of said coded output.

21. The coding method of claim 1, wherein said step (a) includes transforming said input acoustic signal to frequency-domain coefficients, dividing said frequency-domain coefficients into a plurality of subbands, calculating scaling factors of said subbands and normalizing the frequency-domain coefficients of said input acoustic signal by said scaling factors to obtain said residual coefficients.

22. The coding method of claim 1, wherein said step (a) includes subjecting said input acoustic signal to a linear prediction coding analysis to obtain linear prediction coefficients, applying said input acoustic signal to an inverse filter controlled by said linear prediction coefficients to obtain a residual signal and transforming said residual signal to frequency-domain coefficients to obtain said residual coefficients.

23. The coding method of claim 22, wherein a process of obtaining said residual signal includes controlling said inverse filter by providing thereto, as said linear prediction coefficients, quantized linear prediction coefficients obtained by quantizing said linear prediction coefficients and outputting indexes representative of said quantized linear prediction coefficients as another part of said coded output.

24. The coding method of claim 18 or 19, wherein a process of transforming said input acoustic signal to the frequency-domain coefficients includes subjecting said input acoustic signal to lapped orthogonal transform processing on a frame-by-frame basis.

25. An acoustic signal decoding method for decoding an acoustic signal coded after being transformed to frequency-domain coefficients of a predetermined plurality of samples for each frame, said method comprising:

(a) a step wherein fine structure coefficients decoded from input first quantization index information are de-normalized by the envelope of residual coefficients predicted from information about a past frame, whereby reproduced residual coefficients in the current frame are obtained; and (b) a step wherein an acoustic signal added with the envelope of the frequency characteristics of said coded acoustic signal is regenerated from said reproduced residual coefficients obtained in said step (a).

26. The decoding method of claim 25, wherein said step (a) includes a step (c) of synthesizing the envelope of said residual coefficients for a next frame on the basis of said reproduced residual coefficients.

27. The decoding method of claim 26, wherein said step (c) includes: a step (d) of calculating the spectrum envelope of said reproduced residual coefficients; and a step (e) wherein said spectrum envelope of predetermined one or more contiguous past frames preceding the current frame is multiplied by prediction coefficients to obtain the envelope of said residual coefficients of the current frame by linear combination.

28. The decoding method of claim 27, wherein said step (e) includes a step (f) of adaptively controlling said linear combination so that said residual-coefficient envelope obtained by said linear combination comes as close to the envelope of said reproduced residual coefficients in the current frame as possible.

29. The decoding method of claim 28, wherein control of said linear combination in said step (f) is effected for each of a plurality of subbands into which the spectrum envelope of said residual coefficients is divided.

30. The decoding method of claim 27, wherein said step (d) includes: a step (g) of calculating, over the current and past plural frames, average values of corresponding samples of said spectrum envelope obtained from said reproduced residual coefficients, or calculating an average value of the samples in the current frame; and a step (h) of subtracting said average values or average value from said spectrum envelope of the current frame and providing the subtracted result as said spectrum envelope to said step (e), and wherein said step (e) includes a step (i) of adding said average values or average value to the result of said linear combination to obtain said predicted residual coefficients.

31. The decoding method of claim 30, wherein said step (c) includes: a step (j) of calculating an intra-frame average amplitude of said subtracted result obtained in said step (h); a step (k) of dividing the subtracted result in said step (h) by said average amplitude and providing the divided result as said spectrum envelope to said step (e), and wherein said step (e) includes a step (l) of multiplying the result of said linear combination by the average amplitude of said subtracted result and providing the multiplied result as the result of said linear combination to said step (i).

32. The decoding method of any one of claim 27, 28, 30 or 31, wherein said step (d) includes convoluting a window function into the spectrum envelope of said reproduced residual coefficients, and said step (e) includes performing said linear combination by using the convoluted result as said spectrum envelope.

33. The decoding method of any one of claim 27, 28, 30 or 31, wherein said linear combination in said step (e) includes producing a first sample group and a second sample group displaced at least one sample on the frequency axis from a sample group of each of said past frames in the positive and the negative direction, respectively, multiplying said first and second sample groups by prediction coefficients and adding all the multiplied results together with the prediction coefficient-multiplied results for said past frames to obtain said predicted residual-coefficients envelope.

34. The decoding method of any one of claim 27, 28, 30 or 31, wherein said step (e) includes adding a predetermined constant to the result of said linear combination to obtain said residual-coefficients envelope.

35. The decoding method of claim 26, wherein said step (c) includes: a step (e) of calculating the spectrum envelope of said reproduced residual coefficients; and a step (e) of multiplying said spectrum envelopes of predetermined one or more past contiguous frames preceding the current frame by said prediction coefficients specified by inputted third quantization index information and adding the multiplied results to obtain the envelope of said reproduced residual coefficients of the current frame.

36. The decoding method of claim 25, wherein said reproduced residual-coefficients envelope in said step (a) is obtained by linearly combining quantized spectrum envelopes of current and past frames obtained by inverse quantization of index information sent from the coding side.

37. The decoding method of claim 25, wherein said reproduced residual-coefficients envelope in said step (a) is obtained by linearly combining a synthesized residual-coefficients envelope in a past frame and a quantized spectrum envelope of the current frame obtained by inverse quantization of index information sent from the coding side.

38. The decoding method of any one of claim 25, 26, 35, or 36, wherein said step (b) includes: inversely quantizing inputted second quantization index information to decode envelope information of the frequency characteristics of said acoustic signal; and reproducing said acoustic signal provided with the envelope of said frequency characteristics on the basis of the envelope information of said frequency characteristics.

39. The decoding method of claim 38, wherein said step (b) includes: decoding linear prediction coefficients of said acoustic signal as envelope information of said frequency characteristics from said second index, obtaining the envelope of the frequency characteristics of said acoustic signal from said reproduced linear prediction coefficients, de-normalizing said reproduced residual coefficients in said step (a) by the envelope of the frequency characteristics of said acoustic signal to obtain said frequency-domain coefficients, and transforming said frequency-domain coefficients to a time-domain signal to obtain said acoustic signal.

40. The decoding method of claim 39, wherein a process of obtaining the envelope of said frequency characteristics includes subjecting said linear prediction coefficients to Fourier transform processing and obtaining the resulting spectrum amplitude as the envelope of said frequency characteristics.

41. The decoding method of claim 38, wherein said step (b) includes: transforming said reproduced residual coefficients in said step (a) to a time-domain residual signal; decoding linear prediction coefficients of said acoustic signal as envelope information of said frequency characteristics from inputted second quantization index information; and reproducing said acoustic signal by subjecting said residual signal to inverse filter processing through use of said linear prediction coefficients as filter coefficients.

42. The decoding method of claim 38, wherein said step (b) includes dividing said reproduced residual coefficients in said step (a) into a plurality of subbands, decoding from an inputted quantization scaling factor indexes scaling factors corresponding to said subbands as envelope information of said frequency characteristics, de-normalizing said reproduced residual coefficients of the respective subbands by said scaling factors corresponding thereto to obtain frequency-domain coefficients added with the envelope of said frequency characteristics, and transforming said frequency-domain coefficients to a time-domain signal to reproduce said acoustic signal.

43. The decoding method of claim 39, wherein the transformation of said frequency-domain coefficients to said time-domain signal is performed by inverse lapped orthogonal transform.

44. The decoding method of claim 38, wherein said step (b) includes providing said reproduced residual coefficients with an envelope of said frequency characteristics based on the envelope information to produce frequency domain coefficients, and transforming said frequency domain coefficients into the time domain signal to be obtained as the reproduced acoustic signal.

45. The decoding method of claim 44, wherein the transformation of said frequency domain coefficients to said time domain signal is performed by inverse lapped orthogonal transform.

* * * * *